US008546051B2

(12) United States Patent
Otake et al.

(10) Patent No.: US 8,546,051 B2
(45) Date of Patent: Oct. 1, 2013

(54) DEVELOPER BEARING MEMBER AND PROCESS FOR PRODUCING SAME, DEVELOPMENT APPARATUS AND DEVELOPMENT METHOD

(75) Inventors: Satoshi Otake, Numazu (JP); Masayoshi Shimamura, Yokohama (JP); Yasutaka Akashi, Yokohama (JP); Takuma Matsuda, Suntou-gun (JP); Minoru Ito, Susono (JP); Kazuhito Wakabayashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 685 days.

(21) Appl. No.: 12/508,148

(22) Filed: Jul. 23, 2009

(65) Prior Publication Data

US 2010/0028792 A1 Feb. 4, 2010

(30) Foreign Application Priority Data

Jul. 29, 2008 (JP) ..... 2008-194737

(51) Int. Cl.
*G03G 5/07* (2006.01)

(52) U.S. Cl.
USPC ..... 430/62; 430/56

(58) Field of Classification Search
USPC ..... 430/62, 56
See application file for complete search history.

(56) References Cited

U.S. PATENT DOCUMENTS

| | | | | |
|---|---|---|---|---|
| 4,882,255 | A | 11/1989 | Hattori et al. | 430/73 |
| 5,998,008 | A | 12/1999 | Shimamura et al. | 428/323 |
| 6,154,625 | A | 11/2000 | Saiki et al. | |
| 7,361,400 | B2 | 4/2008 | Shimamura et al. | 428/323 |
| 7,585,606 | B2 | 9/2009 | Shimamura et al. | |
| 2005/0048269 | A1 * | 3/2005 | Shimamura et al. | 428/195.1 |
| 2007/0154834 | A1 | 7/2007 | Shimamura et al. | |

FOREIGN PATENT DOCUMENTS

| | | |
|---|---|---|
| EP | 1 528 440 A2 | 5/2005 |
| JP | 01-172969 | 7/1989 |
| JP | 02-105181 | 4/1990 |
| JP | 03-036570 | 2/1991 |
| JP | 03-196165 | 8/1991 |
| JP | 05-216280 | 8/1993 |
| JP | 05-289413 | 11/1993 |
| JP | 07-114216 | 5/1995 |

(Continued)

OTHER PUBLICATIONS

Search Report dated Jun. 8, 2011 in European Application No. 09166625.5.

(Continued)

*Primary Examiner* — Hoa V Le
(74) *Attorney, Agent, or Firm* — Fitzpatrick, Cella, Harper and Scinto

(57) ABSTRACT

A developer bearing member is provided which can charge a toner stably and uniformly during the period from the initial stage to the terminal stage of extensive operation even in various environments. The developer bearing member includes a substrate and an electrically conductive resin coating layer formed on the surface thereof. The electrically conductive resin coating layer is formed from a resin composition containing a phenolic resin having in its structure at least one of an —$NH_2$ group, an =NH group and an —NH— linkage, a quaternary phosphonium salt and electrically conductive fine particles and the resin composition contains 1 part by mass or more and 60 parts by mass or less of the quaternary phosphonium salt with respect to 100 parts by mass of the phenolic resin.

7 Claims, 4 Drawing Sheets

(56) References Cited

FOREIGN PATENT DOCUMENTS

| | | |
|---|---|---|
| JP | 10-293454 | 11/1998 |
| JP | 11-072969 | 3/1999 |
| JP | 2002-040797 | 2/2002 |
| JP | 2002-311637 A | 10/2002 |
| JP | 2003-323041 | 11/2003 |
| JP | 2004-341302 A | 12/2004 |

OTHER PUBLICATIONS

Official Action dated Jan. 17, 2011 in Korean Application No. 10-2009-0069374.

* cited by examiner

DEVELOPER BEARING MEMBER AND PROCESS FOR PRODUCING SAME, DEVELOPMENT APPARATUS AND DEVELOPMENT METHOD

BACKGROUND OF THE INVENTION

1. Field of the Invention

The present invention relates to a developer bearing member and a process for producing the developer bearing member as well as a development apparatus and a development method using the same.

2. Description of the Related Art

Many electrophotographic methods are conventionally known. In general, a photoconductive substance is used to form an electric latent image on an electrostatic latent image bearing member (photosensitive member) by various units, and develops the latent image with a developer (toner) for visualization. Furthermore, the toner image is transferred to a transfer material such as paper as needed, and then the transferred image is fixed on the transfer material by heat, pressure, or the like to produce a copy.

Recently, printers and copiers have been required to have main bodies made smaller, and inevitably containers to store toner also have been required to be made smaller. Under these circumstances, a toner that has particles made nearly spherical is used as a toner that enables many sheets to be printed in a small amount. In addition, a toner whose particles are made uniformly spherical is less in local charge difference and the charge quantity is very uniform. For this reason, such a toner is also advantageous in terms of producing high-quality images. Therefore, making toner particles spherical as well as making particle sizes smaller and making particles finer, has come to be prevailing.

However, a toner having a small particle size has a large surface area per unit mass, and so its high surface charge is apt to become large during the course of development. In addition, a toner whose particles are made spherical has a smoother surface than conventional ground toner and its particles easily encapsulate a magnetic material, so its charge quantity tends to be too large.

Especially, as a developer bearing member rotates repeatedly, the charge quantity of the toner carried by the developer bearing member becomes too large because of contact with the developer bearing member, and in some cases, the toner is strongly attracted to the surface of the developer bearing member and immobilized on the surface. In this case, the toner is not transferred from the developer bearing member to a latent image on a photosensitive drum, in other words, a charge-up phenomenon occurs. This charge-up phenomenon is liable to occurs at low humidity. The occurrence of the charge-up phenomenon makes it difficult for the toner located at the upper portion of the toner layer carried by the developer bearing member to be charged, resulting in a decrease in the amount of toner for development. As a result, problems are raised in that lines on an electrophotographic image become thinner and the image density of a solid image is reduced. In addition, it is difficult for the toner that is not suitably charged because of the charge-up to be held in place on the developer bearing member, and in some cases, the toner flows out on the surface of the developer bearing member. In this case, defects in the form of blotches due to the toner flowing out, i.e., a blotch phenomenon appears on an electrophotographic image.

Moreover, a state in which a toner layer is formed is different between an image portion (toner-consuming portion) and a non-image portion, and in some cases, a charge state comes to be different. For example, when a location at which a solid image having a high image density has been developed once on the developer bearing member comes to a development location at the next rotation of the developer bearing member and a half-tone image is developed, what is called a sleeve ghost phenomenon is liable to occur in which traces of the solid image appear on the half-tone image.

As a method for controlling the charge quantity imparted to toner by a developer bearing member, a technique has been conventionally used in which the surface chargeability of the developer bearing member is changed. Japanese Patent Application Laid-Open No. H02-105181 and Japanese Patent Application Laid-Open No. H03-036570 disclose a method in which a developer bearing member is used having a coating layer in which an electrically conductive fine powder such as crystalline graphite and carbon is dispersed in a resin to improve the electrical conducting properties of the developer bearing member and to thereby prevent excess charging.

In addition, Japanese Patent Application Laid-Open No. H07-114216, Japanese Patent Application Laid-Open No. H10-293454 (U.S. Pat. No. 5,998,008), Japanese Patent Application Laid-Open No. H05-289413, and Japanese Patent Application Laid-Open No. H11-072969 disclose that in order to impart excellent negative chargeability to negatively chargeable toner, a positively chargeable charge control agent (a charge control agent whose frictional charge with a negatively chargeable toner is positive) is included in the surface layer of a developer bearing member.

Specifically, as such charge control agents, Japanese Patent Application Laid-Open No. H10-293454 discloses a nitrogen-containing heterocyclic compound, Japanese Patent Application Laid-Open No. H07-114216 discloses a quaternary ammonium salt compound, and Japanese Patent Application Laid-Open No. H05-289413 and Japanese Patent Application Laid-Open No. H11-072969 disclose a quaternary phosphonium salt compound, or nigrosine and modified products with metal salts of fatty acids.

In addition, Japanese Patent Application Laid-Open No. H03-196165 and Japanese Patent Application Laid-Open No. H05-216280 disclose that in order to impart excellent positive chargeability to a positively chargeable toner, a negatively chargeable charge control agent (a charge control agent whose charge due to friction with a positively chargeable toner is negative) is included in the surface layer of a developer bearing member. As such charge control agents, Japanese Patent Application Laid-Open No. H03-196165 and Japanese Patent Application Laid-Open No. H05-216280 disclose a fluorine-containing compound, or metal complexes such as a monoazo metal complex and an acetylacetone metal complex. However, the techniques disclosed by the above prior art rather increase the charge-up for toners that are easily charged.

On the other hand, in order to suppress the charge-up of toners that are easily charged, the use of a developer bearing member including a surface layer containing a charge control agent having the same polarity as the toner charge polarity is effective in some cases. That is, the use of a negative-polarity charge control agent for a resin coating layer of a developer bearing member can suppress the charge-up for toners that are easily negatively charged and is effective in preferably controlling the quantity of charge. However, if a control agent that is incompatible with resin, such as a negatively chargeable nigrosine dye and an azo-type iron complex, is dispersed, when a resin layer is formed, the control agent is unevenly distributed in the resin layer in some cases. In this case, it is difficult to uniformly charge the toner. In addition, the wear of the developer bearing member due to heavy-use is liable to cause loss of the charge control agent, with the result that the charge controlling effect is lowered and charging properties become poor, thereby producing image defects in some cases. In addition, if a fluorine-containing charge control agent is used, because of its high polarity, the control agent tends to be arranged on the surface of the coating layer. In this case, when the developer bearing member is worn due to heavy-use, the abundance ratio of the charge control agent is reduced, with the result that the charge controlling effect is lowered and charging stability to the toner becomes insufficient, thereby tending to produce image defects such as degraded image quality.

In addition, Japanese Patent Application Laid-Open No. 2002-040797 discloses a developer bearing member having a surface layer formed by using a coating material containing a quaternary ammonium salt and a phenolic resin. This developer bearing member can suppress the charge-up of a developer and stably impart an appropriate charge to the developer.

SUMMARY OF THE INVENTION

However, the present inventors have studied in detail the invention according to Japanese Patent Application Laid-Open No. 2002-040797 and found a problem with the production process. The problem is that in order to suppress an excess charge on a developer that is especially easily charged, when a coating material is prepared in which a larger amount of a quaternary ammonium salt is added to a phenolic resin, the storage stability of the coating material is lowered. This problem occurs because the addition of the quaternary ammonium salt makes it easy for the phenolic resin to be cross-linked at normal temperature, and the molecular weight of the resin increases during long-term storage, thereby increasing the solution viscosity. In addition, when the coating material is diluted with a solvent, the gelation thereof is liable to be brought about. Pigment aggregates are found in some cases on a surface layer formed by using the gelated coating material. In a developer bearing member having such a surface layer, the wear resistance of the surface layer is lowered, thereby causing image defects such as development streaks on electrophotographic images.

Therefore, the present invention is aimed at providing a developer bearing member that suppresses the charge-up of a toner being easily charged such as a toner having a high sphericity or a toner having a small particle size, can impart an appropriate frictional charge, and inhibits image defects resulting from the problem with the production process.

The present inventors have conducted extensive studies to solve the problem of the quaternary ammonium salt and found that the combination of a quaternary phosphonium salt and a specific phenolic resin can successfully solve the problem.

A developer bearing member according to the present invention includes a substrate and an electrically conductive resin coating layer formed on the surface thereof, wherein the electrically conductive resin coating layer is formed from a resin composition containing a phenolic resin having in its structure at least one selected from the group consisting of an —$NH_2$ group, an =NH group and an —NH— linkage, a quaternary phosphonium salt and electrically conductive fine particles, and the resin composition contains 1 part by mass or more and 60 parts by mass or less of the quaternary phosphonium salt with respect to 100 parts by mass of the phenolic resin.

In addition, a development apparatus according to the present invention includes a negatively chargeable developer, a development container for storing the negatively chargeable developer, a developer bearing member rotatively held to carry on its surface and convey the negatively chargeable developer fed from the development container, and a developer layer thickness control member for controlling the thickness of a layer of the negatively chargeable developer formed on the developer bearing member, wherein the developer bearing member is the afore-mentioned developer bearing member.

In addition, a development method according to the present invention includes using the development apparatus to convey a developer to a development region opposite to an electrostatic latent image bearing member and to develop the electrostatic latent image carried on the electrostatic latent image bearing member with the conveyed developer.

Moreover, a process for producing a developer bearing member according to the present invention is a process for producing a developer bearing member including a substrate and an electrically conductive resin coating layer formed thereon, which includes forming on the surface of the substrate a coating of a coating material containing a phenolic resin having in its structure at least one selected from the group consisting of an —$NH_2$ group, an =NH group and an —NH— linkage, a solvent for dissolving the phenolic resin, a quaternary phosphonium salt and electrically conductive fine particles, and curing the coating to form the electrically conductive resin coating layer, wherein the coating material contains 1 part or more and 60 parts by mass or less of the quaternary phosphonium salt with respect to 100 parts by mass of the phenolic resin.

According to the present invention, a developer bearing member which can stably and uniformly charge a toner and lasts long under various environments can be provided. In addition, a development apparatus and a development method can be provided which can control the charge-up phenomenon, destabilized frictional charging and an increase in the amount of carried developer which are liable to appear during image formation using a toner easily having a large quantity of frictional charge, such as a toner having a high sphericity or a toner having a small particle size.

Further features of the present invention will become apparent from the following description of exemplary embodiments with reference to the attached drawings.

DESCRIPTION OF THE EMBODIMENTS

<Developer Bearing Member>

Figure 1:
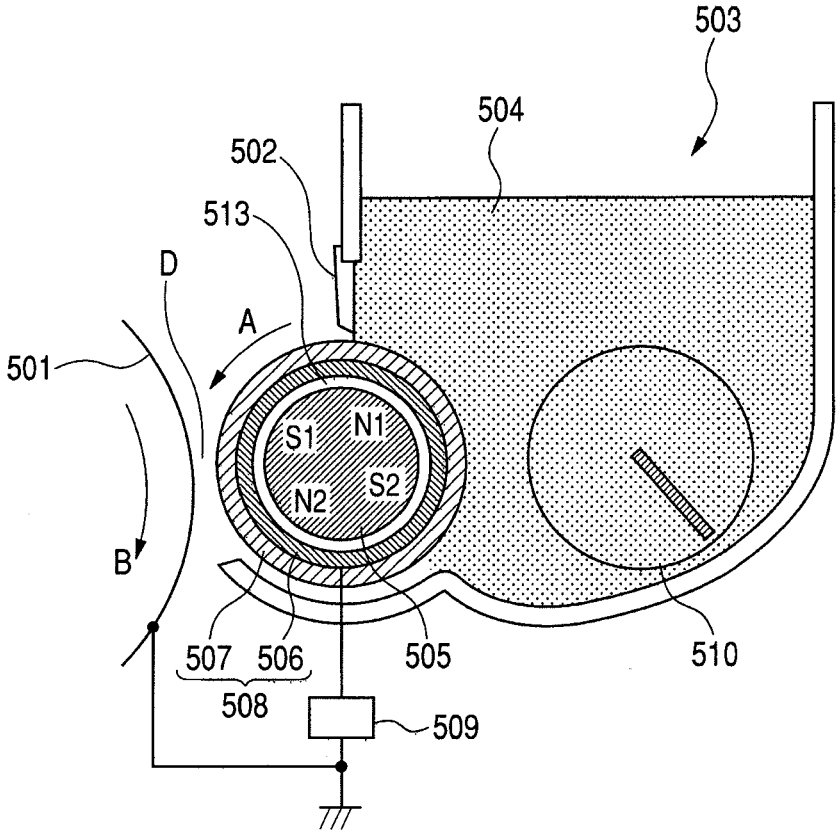
FIG. 1 is a schematic view of an example of a development apparatus used in the development method of the present invention.

The developer bearing member according to the present invention has a substrate and an electrically conductive resin coating layer formed thereon.

<Electrically Conductive Resin Coating Layer>

The electrically conductive resin coating layer is formed from a resin composition containing a phenolic resin having in its structure at least one of an —$NH_2$ group, an ═NH group and an —NH— linkage, a quaternary phosphonium salt and electrically conductive fine particles. The resin composition contains 1 part by mass or more and 60 parts by mass or less of the quaternary phosphonium salt with respect to 100 parts by mass of the phenolic resin.

In the present invention, it is important in imparting good chargeability to a developer that a resin composition containing a phenolic resin having a specific group in the structure and a quaternary phosphonium salt is used to form an electrically conductive resin coating layer.

Examples of the quaternary phosphonium salt include compounds represented by the general Formula (1) below:

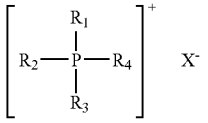

(1)

In Formula (1), $R_1$ to $R_3$ each independently represent an alkyl group having 1 to 4 carbon atoms that may have a substituent, a phenyl group that may have a substituent or a benzyl group that may have a substituent; and $R_4$ represents an alkyl group having 1 to 16 carbon atoms that may have a substituent, an alkenyl group that may have a substituent, an alkynyl group that may have a substituent, a phenyl group that may have a substituent or a benzyl group that may have a substituent. The number of carbon atoms of the alkenyl group and alkynyl group that may have a substituent is preferably 2 or more and 16 or less. Examples of the substituent include a halogen atom, an oxygen atom, a nitrogen atom, or a sulfur atom, or groups formed by these atoms and a carbon atom, an alkyl group, an alkenyl group, an alkynyl group, an aryl group, a hydroxyl group, a nitro group and a cyano group. However, the substituent is not limited thereto. In addition, at least three functional groups of $R_1$ to $R_4$ each are preferably a butyl group that may have a substituent, a phenyl group that may have a substituent and a benzyl group that may have a substituent. In this case, the dispersion uniformity of the quaternary phosphonium salt in the phenolic resin tends to be improved, and as a result, the developer bearing member can have a uniform and high negative chargeability.

In Formula (1), $X^-$ represents a negative ion selected from the group consisting of halogen ions, $OH^-$ and organic acid or inorganic acid ions. Examples of the organic acid or inorganic acid ions include organic sulfate ions, organic sulfonate ions, organic phosphate ions, molybdate ions, tungstate ions, and heteropolyacid ions each containing a molybdenum atom or a tungsten atom. In addition, $X^-$ represents preferably a halogen ion or $OH^-$ because a coating material prepared by addition of such a quaternary phosphonium salt to a phenolic resin is apt to have better storage stability. Table 1 shows examples of the quaternary phosphonium salt preferably used in the present invention.

TABLE 1

| | $R_2$—$P^+$(—$R_1$)(—$R_3$)—$R_4$ | $X^-$ |
|---|---|---|
| 1 | $R_1$, $R_2$, $R_3$: phenyl group<br>$R_4$: $(CH_2)_3CH_3$ | $Br^-$ |
| 2 | $R_1$, $R_2$, $R_3$: phenyl group<br>$R_4$: $CH_2CH{=}CH_2$ | $Br^-$ |
| 3 | $R_1$, $R_2$, $R_3$: phenyl group<br>$R_4$: $CH_2CH_3$ | $I^-$ |
| 4 | $R_1$, $R_2$, $R_3$: phenyl group<br>$R_4$: $CH_2$-phenyl | $Br^-$ |
| 5 | $R_1$, $R_2$, $R_3$, $R_4$: phenyl group | $Br^-$ |
| 6 | $R_1$, $R_2$, $R_3$: phenyl group<br>$R_4$: $(CH_2)_3CH_3$ | $I^-$ |
| 7 | $R_1$, $R_2$, $R_3$, $R_4$: phenyl group | $I^-$ |
| 8 | $R_1$, $R_2$, $R_3$: phenyl group<br>$R_4$: $(CH_2)_3CH_3$ | $Cl^-$ |
| 9 | $R_1$, $R_2$, $R_3$, $R_4$: $CH_2CH_3$ | $OH^-$ |
| 10 | $R_1$, $R_2$, $R_3$: phenyl group<br>$R_4$: $(CH_2)_3CH_3$ | $I^-$ |
| 11 | $R_1$, $R_2$, $R_3$: phenyl group<br>$R_4$: $CH_2{=}CH$ | $Br^-$ |
| 12 | $R_1$, $R_2$, $R_3$: phenyl group<br>$R_4$: $CH_2CO(OCH_3)$ | $Br^-$ |
| 13 | $R_1$, $R_2$, $R_3$: phenyl group<br>$R_4$: $(CH_2)_3CH_3$ | 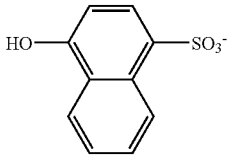 |
| 14 | $R_1$, $R_2$, $R_3$: phenyl group<br>$R_4$: $CH_2CH{=}CH_2$ | 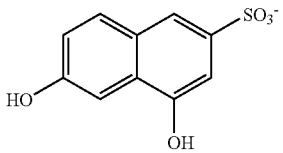 |
| 15 | $R_1$, $R_2$, $R_3$: phenyl group<br>$R_4$: $(CH_2)_3CH_3$ | 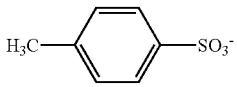 |
| 16 | $R_1$, $R_2$, $R_3$, $R_4$:<br>$CH_2CH_2CH_2CH_3$ | $Br^-$ |
| 17 | $R_1$, $R_2$, $R_3$: phenyl group<br>$R_4$: $(CH_2)_3CH_3$ | $1/4Mo_8O_{26}^{4-}$ |
| 18 | $R_1$, $R_2$, $R_3$: $(CH_2)_3CH_3$<br>$R_4$: $(CH_2)_{15}CH_3$ | $Br^-$ |

As mentioned above, a quaternary phosphonium salt is generally used as a positively chargeable charge control agent to increase the quantity of charge of a positively chargeable toner. However, a resin coating layer formed by using a coating material prepared by mixing a quaternary phosphonium salt with a phenolic resin having a specific structure acts to try to reduce the positive chargeability of the quaternary phosphonium salt itself and can prevent a negatively chargeable toner from being excessively charged. This can prevent the charge-up of the toner on the developer bearing member, maintain the high charging stability of the toner, and thus provide a high-definition image having especially environmental stability such as at low temperature and low humidity and long-term stability.

The reason why the combination of a quaternary phosphonium salt that is originally a positive chargeable charge control agent and a specific phenolic resin produces the effect above is unclear, but is considered as follows. A quaternary phosphonium salt according to the present invention is added to and uniformly dispersed in a phenolic resin having at least one of an —$NH_2$ group, an =NH group and an —NH— linkage. Next, when the resin is heated and cured, some interaction acts between the quaternary phosphonium salt and the —$NH_2$ group, =NH group or —NH— linkage during crosslinking and allows the quaternary phosphonium salt to enter the phenolic resin skeleton. Then, in the binder resin with the quaternary phosphonium salt being incorporated therein, the charge polarity of the counter ion of the quaternary phosphonium ion comes to be expressed, and as a result, it is considered that the resin coating layer having such a compound has negative chargeability. The presence of these quaternary phosphonium salts can be checked, for example, by measuring with GC-MS or the like a sample collected by grinding, or extracting with a solvent such as chloroform, the surface of the developer bearing member.

In addition, a coating material prepared by adding a quaternary phosphonium salt and an electrically conductive fine particle to a phenolic resin having in its structure any one of an —$NH_2$ group, an =NH group and an —NH— linkage has very good storage stability. For example, a resin composition prepared by dispersing an azo-type iron complex compound and/or the like in a phenolic resin undergoes significant changes in physical properties due to storage, such as a decrease in solution viscosity, aggregation of particles in the solution and an increase in volume resistance when formed into a resin coating layer. In addition, in a coating material prepared by adding a quaternary ammonium salt to a phenolic resin, the cross-linking reaction of the phenolic resin is accelerated even at normal temperature in some cases. In this case, the long-term storage of the coating material may increase the molecular weight of the resin and the solution viscosity, whereas dilution of the coating material with a solvent may cause gelation, triggering the production of pigment aggregates. In the coating material according to the present invention, a quaternary phosphonium salt is very compatible with a phenolic resin, is apt to exist uniformly in the resin, and brings about almost no reaction with the phenolic resin in a high-temperature environment. For these reasons, even when the coating material is stored for a long time, a change in the viscosity of the coating material and the aggregation of particles in the coating material are difficult to bring about, resulting in good storage stability. In addition, even a coating material having such a history that the coating material has been stored in a high-temperature environment allows for forming a resin coating layer less in coating defects that may cause image defects.

As a binder resin for the electrically conductive resin coating layer constituting the developer bearing member of the present invention, a phenolic resin having in its structure at least one of an —$NH_2$ group, an =NH group and an —NH— linkage is used. An example of such a phenolic resin includes a phenolic resin produced by using a nitrogen-containing compound such as ammonia as a catalyst in the production process of the phenolic resin. The nitrogen-containing compound as a catalyst is directly involved in the polymerization reaction and exists in the phenolic resin even after completion of the reaction. For example, polymerization in the presence of an ammonia catalyst is generally known to produce an intermediate called ammonia resol, and the intermediate having a structure represented by Formula (2) exists in the phenolic resin even after completion of the reaction.

(2)

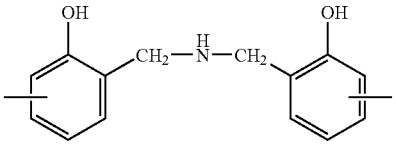

The nitrogen-containing compound as a catalyst may be any one of an acidic catalyst and a basic catalyst. For example, examples of the acidic catalyst include ammonium salts such as ammonium sulfate, ammonium phosphate, ammonium sulfamate, ammonium carbonate, ammonium acetate and ammonium maleate or amine salts. Examples of the basic catalyst include: ammonia; amino compounds such as dimethylamine, diethylamine, diisopropylamine, diisobutylamine, diamylamine, trimethylamine, triethylamine, tri-n-butylamine, triamylamine, dimethylbenzylamine, diethylbenzylamine, dimethylaniline, diethylaniline, N,N-di-n-butylaniline, N,N-diamylaniline, N,N-di-t-amylaniline, N-methylethanolamine, N-ethylethanolamine, diethanolamine, triethanolamine, dimethylethanolamine, diethylethanolamine, ethyldiethanolamine, n-butyldiethanolamine, di-n-butylethanolamine, triisopropanolamine, ethylenediamine and hexamethylenetetramine; pyridine and derivatives thereof such as pyridine, α-picoline, β-picoline, γ-picoline and 2,4-lutidine, and 2,6-lutidine; nitrogen-containing heterocyclic compounds including imidazole and derivatives thereof such as quinoline compounds, imidazole, 2-methylimidazole, 2,4-dimethylimidazole, 2-ethyl-4-methylimidazole, 2-phenylimidazole, 2-phenyl-4-methylimidazole and 2-heptadecylimidazole.

Analysis can be conducted by measurement with infrared absorption spectroscopy (IR), nuclear magnetic resonance spectrometry (NMR) or the like to check that a phenolic resin has at lest one of an —$NH_2$ group, an =NH group and an —NH— linkage in its structure.

The electrically conductive resin coating layer formed on the developer bearing member of the present invention has a volume resistivity of preferably $10^4$ Ω·cm or less, and more preferably $10^3$ Ω·cm or less. A volume resistivity in this range can inhibit a developer from being fixed onto the developer bearing member due to charge-up, and can inhibit poor transfer of frictional charge from the surface of the developer bearing member to a developer from occurring with the charge-up of the developer. If the electrically conductive resin coating layer formed on the developer bearing member has a volume resistivity higher than $10^4$ Ω·cm, frictional charge is likely to be poorly transferred to the developer, tending to result in blotches (speckled images and wave pattern images) and reduced image density.

To adjust the volume resistance of the electrically conductive resin coating layer within the above range, it is preferable that electrically conductive fine particles are included in the electrically conductive resin coating layer. Examples of the electrically conductive fine particles used in this case preferably include fine particles of metals such as aluminum, copper, nickel and silver; electrically conductive metal oxides such as antimony oxide, indium oxide, tin oxide, titanium oxide, zinc oxide, molybdenum oxide and potassium titanate; graphitized particles; various carbon fibers; electrically conductive carbon blacks such as furnace black, lampblack, thermal black, acetylene black and channel black; and metal fibers. The electrically conductive fine particles may also be a mixture of these.

Electrically conductive carbon blacks, in particular, electrically conductive amorphous carbon, are preferably used because they have especially excellent electrical conduction properties and allow for obtaining arbitrary electrical conductivity to some extent by adding them to a polymer material to impart electrical conduction properties and just controlling the amount of them to be added. In addition, these carbon blacks also provide good dispersion stability and coating stability because of the thixotropic effect when prepared into coating materials.

Graphitized particle is preferable because it is in excellent in electrical conduction and has increased surface lubricity when added to the electrically conductive coating layer, improving the durability of the electrically conductive coating layer. Especially, in the present invention, graphitized particle having a graphitization degree p (002) of 0.20 to 0.95 is preferable as the coating strength of the electrically conductive resin coating layer and the surface lubricity of the electrically conductive resin coating layer are increased. These graphitized particles are described in Japanese Patent Application Laid-Open No. 2003-323041.

The amount of electrically conductive fine particles to be added also varies depending on their particle sizes, and is preferably in the range of 1 part by mass to 100 parts by mass with respect to 100 parts by mass of the binding resin. An amount of less than 1 part by mass usually makes it difficult to reduce the resistance of the electrically conductive resin coating layer to the desired level, and is likely to cause toner to adhere to the binding resin used in the electrically conductive resin coating layer. An amount of more than 100 parts by mass may reduce the strength (wear resistance) of the electrically conductive resin coating layer.

In addition, in the present invention, a further advantageous result can be obtained by adding roughening particles for the formation of irregularities to the electrically conductive resin coating layer to make surface roughness uniform and maintain appropriate surface roughness.

The roughening particles for the formation of irregularities used in the present invention are preferably spherical. Spherical particles can provide the desired surface roughness in a smaller amount than amorphous particles and an irregular surface having a uniform surface shape. Moreover, even when the coating layer surface has been worn, the surface roughness of the coating layer is less changed and the thickness of the toner layer on the developer bearing member is difficult to change. For these reasons, such particles can exert for a long term the effects of making toner charge uniform, of inhibiting sleeve ghosts from occurring, of making it difficult to bring about streaks and unevenness and of making it difficult to bring about sleeve contamination and fusion by the toner on the developer bearing member due to the toner.

The spherical particles used in the present invention preferably have a volume-average particle size of 0.3 μm to 30 μm. When the volume-average particle size is less than 0.3 μm, the little of imparting uniform surface roughness to the coating layer surface is less exhibited, and thus, toner charge-up due to the wear of the coating layer and sleeve contamination and fusion by the toner are liable to occur. Thereby, poor images due to sleeve ghosts and decreased image density tend to occur. When the volume-average particle size is greater than 30 μm, the surface roughness of the coating layer is so large that the amount of toner to be conveyed increases, thereby making the toner coating of the development sleeve surface nonuniform and making it difficult to uniformly charge the toner. In addition, the protrusion of coarse particles may cause image streaks and white spots and black spots due to bias leaks. Moreover, it may be a cause of decreasing the mechanical strength of the coating layer.

The term "spherical" of the spherical particles used in the present invention refers to a ratio of about 1.0 to 1.5 of the major axis/the minor axis, and in the present invention, the ratio of the major axis/the minor axis is preferably 1.0 to 1.2, and it is particularly preferable to use perfectly spherical particles. If the ratio of the major axis/the minor axis of spherical particles exceeds 1.5, the dispersibility of the spherical particles in the coating layer is lowered, and so, in order to obtain the desired surface roughness, the particles are required to be added in a larger amount, and the surface shape of the coating layer is liable to be rendered non-uniform. In addition, such a ratio may cause non-uniform toner charging and lower the strength of the coating layer.

The spherical particles used in the present invention have preferably a true density of 3 g/cm$^3$ or less. If the spherical particles have a true density of greater than 3 g/cm$^3$, the particles need to be added in a larger amount to achieve appropriate surface roughness. In this case, the difference in density between the particles and the binding resin is so large that the spherical particles are poorly dispersed in the coating layer and it is difficult to impart uniform roughness to the coating layer surface and to uniformly charge the toner.

Furthermore, in the present invention, it is preferable to use electrically conductive spherical particles as the spherical particles. Imparting electrical conduction properties to spherical particles can make it more difficult for charge to accumulate on the surface of the particles than on the surface of electrical insulating particles because of their electrical conduction properties. Therefore, when including such electrically conductive spherical particles in the coating, the adhesion to the toner particles is reduced with the result that the sources of sleeve contamination and fusion by the toner are reduced. For these reasons, such electrically conductive spherical particles have the effect of further improving the properties of charging the toner and the developability.

In addition, electrically conductive spherical particles used in the present invention refer to spherical particles having a volume resistivity of $10^6$ Ω·cm or less, and it is preferable to use particles having a volume resistivity of $10^6$ Ω·cm to $10^{-3}$ Ω·cm are preferably used. If electrically conductive spherical particles have a volume resistivity of greater than $10^6$ Ω·cm, the effect of making the particles electrically conductive is reduced, specifically, the effect of suppressing sleeve contamination and fusion by the toner by using as cores spherical particles exposed on the electrically conductive coating layer surface due to wear, is reduced in some cases.

In addition, the dispersion of a solid lubricant along with spherical particles in the electrically conductive coating layer is preferable because the surface lubrication increases and the durability of the electrically conductive coating layer increases. Examples of this solid lubricant include crystalline graphite, molybdenum disulfide, boron nitride, mica, graphite fluoride, silver-niobium selenide, calcium chloride-graphite, talc and substances containing metal salts of fatty acids such as zinc stearate. Among these, as mentioned previously, crystalline graphite, especially graphitized particles having a degree of graphitization p (002) of 0.20 to 0.95 are preferable because the use of them with spherical particles does not reduce the electrical conduction properties of the electrically conductive coating layer.

In addition, the amounts of these solid lubricants usable in the present invention are preferably in the range of 1 part by mass to 100 parts by mass with respect to 100 parts by mass of the binding resin. With an amount of less than 1 part by mass, the effect of improving the adhesion of a developer to the surface of the binding resin used in the electrically conductive resin coating layer is reduced. With an amount of greater than 100 parts by mass, the strength (wear resistance) of the electrically conductive resin coating layer may be reduced, especially when a material containing a large amount of fine particles having a submicron particle size much is used.

The solid lubricant is preferably in the form of particles. These lubricative particles have a volume-average particle size of preferably 0.2 μm or more and 20 μm or less, and more preferably 1 μm or more and 15 μm or less. A lubricative particle volume-average particle size of less than 0.2 μm makes it difficult to provide sufficient lubrication. A volume-average particle size of greater than 20 μm is liable to make the surface properties non-uniform because of its great influence on the shape of the electrically conductive resin coating layer surface, and in some cases, the developer is non-uniformly charged and the strength of the electrically conductive resin coating layer is insufficient.

Examples of a substrate used in the developer bearing member of the present invention include a cylindrical member, a columnar member and a belt-shaped member, and in a development method in which the substrate does not come into contact with the drum, it is preferable to use a cylindrical tube formed of a rigid body such as a metal or a solid rod. As these substrates, a non-magnetic metal or alloy such as aluminum, stainless steel or brass that is fabricated in cylindrical or columnar form and subjected to process such as polishing and grinding is preferably used. These substrates are fabricated or processed with high precision before use to improve image uniformity. For example, the straightness in the longitudinal direction is preferably 30 μm or less, more preferably 20 μm or less and much more preferably 10 μm or less. In addition, the fluctuation in the gap between the substrate and a photosensitive drum, for example, the fluctuation in the gap between the substrate and a vertical plane when the substrate is pressed against a vertical plane through a uniform spacer and the sleeve is rotated, is preferably 30 μm or less, more preferably 20 μm or less and much more preferably 10 μm or less. Aluminum is preferably used in view of material cost and ease of processing.

In addition, as a substrate in a case where a development method is used in which the substrate is directly brought into contact with the photosensitive drum, a columnar member having a layered structure including a layer formed from rubber or elastomer such as urethane, EPDM or silicone on a mandrel is preferably used. In addition, in a development method that uses a magnetic developer, a magnet roller or the like with a magnet provided therein is arranged in the developer bearing member to magnetically attract and maintain the developer on the developer bearing member. In this case, it is necessary to make the substrate cylindrical and arrange the magnet roller therein.

As an example of a method of forming an electrically conductive resin coating layer, an electrically conductive resin coating layer can be formed by dispersing and mixing the components for the electrically conductive resin coating layer in a solvent to prepare a coating material, applying the coating material to the substrate surface to form a coating, and then drying and solidifying or curing the coating. To disperse and mix the components in the coating solution, a known dispersing apparatus using beads such as a sand mill, a paint shaker, a Dyno mill or a pearl mill can preferably be used. In addition, as a coating method, a known method such as dipping, spraying or roll coating is applicable. Especially, spraying is preferably used in the present invention because a combination with a solvent as described later facilitates the control of the presence of sulfur and molybdenum elements in the electrically conductive resin coating layer.

In the present invention, as the surface roughness of the electrically conductive resin coating layer, the arithmetic average roughness Ra (JIS B0601-2001) is preferably 0.3 μm to 2.0 μm, and more preferably 0.4 μm to 1.5 μm. If Ra of the electrically conductive resin coating layer surface is less than 0.4 μm, the electrically conductive resin coating layer surface has almost no irregularities, so the amount of a developer on the developer bearing member becomes unstable and the resistance to wear and developer contamination of the electrically conductive resin coating layer becomes insufficient in some cases. If Ra exceeds 1.5 μm, the amount of developer conveyed on the developer bearing member is too large, and in some cases, it is difficult to impart a uniform charge to the developer and the mechanical strength of the electrically conductive resin coating layer decreases.

The electrically conductive resin coating layer having the constitution as described above has a thickness of preferably 25 μm or less, more preferably 20 μm or less and much more preferably 4 μm to 20 μm in order to obtain a uniform thickness, but the thickness is not limited thereto. The thickness can be obtained by setting the coating mass at 4,000 mg/m$^2$ to 20,000 mg/m$^2$ depending on the materials used for the electrically conductive resin coating layer.

Next, a development apparatus into which the developer bearing member of the present invention is incorporated will be described and exemplified. The development apparatus of the present invention includes at least a negatively chargeable developer, a development container, a developer bearing member and a developer layer thickness control member, wherein the developer bearing member is the foregoing developer bearing member. The negatively chargeable developer is stored in the development container. The developer bearing member carries the negatively chargeable developer fed from the development container on the surface of the developer bearing member and conveys the negatively chargeable developer, and is held rotatively. The developer layer thickness control member is to control the thickness of the negatively chargeable developer layer formed on the developer bearing member. Development can be conducted with such a development apparatus by a method in which the developer is conveyed to a development region opposite to the electrostatic latent image bearing member and the electrostatic latent image carried on the electrostatic latent image bearing member is developed with the conveyed developer for visualization.

FIG. 1 is a schematic sectional view of a development apparatus that is an embodiment having a developer bearing member of the present invention. In FIG. 1, an electrophotographic photosensitive drum 501 as an electrostatic latent image bearing member to carry an electrostatic latent image formed by a known process is rotated in the direction of an arrow B. A development sleeve 508 as the developer bearing member carries a one-component developer 504 including a magnetic toner fed by a hopper 503 as the developer container and rotates in the direction of an arrow A.

Thus, the developer 504 is conveyed to a development region D where the development sleeve 508 and the photosensitive drum 501 are opposite to each other. As illustrated in FIG. 1, in the development sleeve 508, a magnet roller 505 with magnets touched internally thereto is arranged to magnetically attract and hold the developer 504 on the development sleeve 508.

The development sleeve 508 used in the development apparatus of the present invention has a cylindrical metal tube 506 as the substrate and an electrically conductive resin coating layer 507 covering the tube. In the hopper 503, a stirring blade 510 to stir the developer 504 is provided. There is a gap 513 between the development sleeve 508 and the magnet roller 505. The developer 504 obtains frictional charge sufficient to develop the electrostatic latent image on the photosensitive drum 501 from the friction between the magnetic toners making up the developer and between the developer and the electrically conductive resin coating layer 507 on the development sleeve 508.

In the example of FIG. 1, a ferromagnetic metal-made magnetic control blade 502 as a developer layer thickness control member is provided to control the layer thickness of the developer 504 conveyed to the development region D. This magnetic control blade 502 hangs from the hopper 503 to face the development sleeve 508 with a gap width of about 50 to 500 μm from the surface of the development sleeve 508. The magnetic lines of force from a magnetic pole N1 of the magnet roller 505 are focused on the magnetic control blade 502 to form a thin layer of the developer 504 on the development sleeve 508. In the present invention, a non-magnetic blade can also be used instead of the magnetic control blade 502.

The thickness of the thin layer of the developer 504 formed on the development sleeve 508 as mentioned above is preferably thinner than the minimum gap between the development sleeve 508 and the photosensitive drum 501 in the development region D.

The developer bearing member of the present invention is effective especially when it is incorporated into a development apparatus that develops an electrostatic latent image by using a thin developer layer as described above, in other words, into a noncontact development apparatus. The developer bearing member of the present invention is also applicable to a development apparatus in which the thickness of the developer layer is equal to or greater than the minimum gap between the development sleeve 508 and the photosensitive drum 501 in the development region D, in other words, to a contact development apparatus.

To avoid complicated description, the following description will be given by using as an example the noncontact development apparatus as mentioned above.

To fly the one-component developer 504 having a magnetic toner carried on the development sleeve 508, a development bias voltage is applied to the development sleeve 508 from a development bias power supply 509 as a biasing unit. If direct-current voltage is used as this development bias voltage, a voltage between the potential of the image portion of the electrostatic latent image (region visualized by adhering the developer 504) and the potential of the background portion is preferably applied to the development sleeve 508.

In addition, in the case of the so-called charged-area development in which a toner is adhered to the high potential portion of an electrostatic latent image having a high potential portion and a low potential portion for visualization, a toner charged with a polarity opposite to the polarity of the electrostatic latent image is used.

In the case of the so-called discharged-area development in which a toner is adhered to the low potential portion of an electrostatic latent image having a high potential portion and a low potential portion for visualization, a toner charged with the same polarity as the polarity of the electrostatic latent image is used. Here, high potential and low potential are represented by absolute values. In either case, the developer 504 is charged at least by friction with the development sleeve 508.

Figure 2:
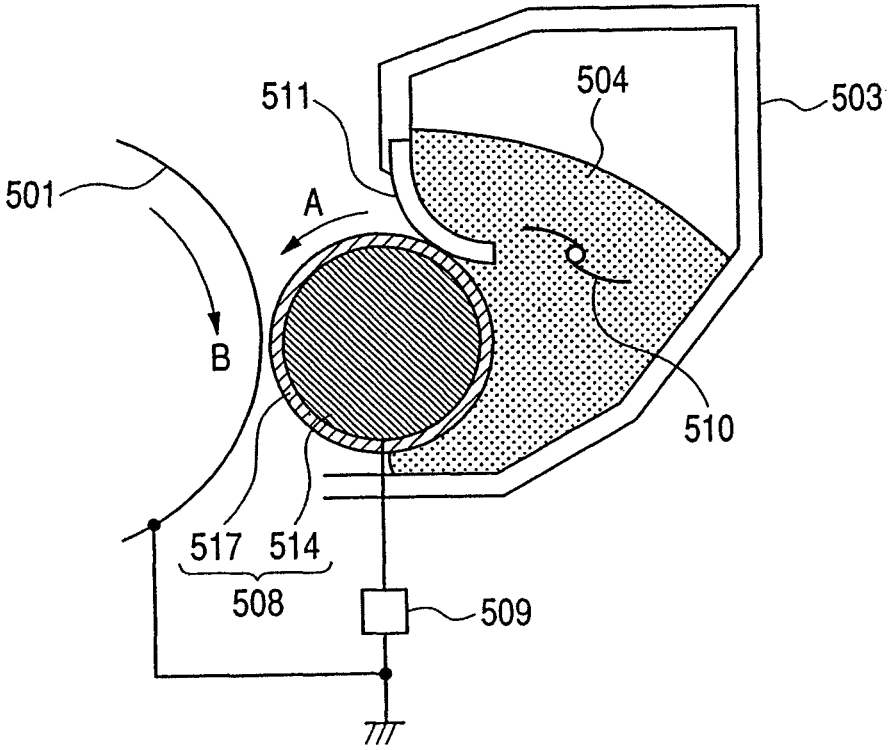
FIG. 2 is a schematic view of an example of a development apparatus used in the development method of the present invention.

FIG. 2 is a schematic sectional view of the constitution of another embodiment of the development apparatus of the present invention.

The development apparatus illustrated in FIG. 2 uses an elastic control blade 511 as a developer layer thickness control member to control the layer thickness of the developer 504 on the development sleeve 508. The elastic control blade 511 includes an elastic plate made of a material having rubber elasticity such as urethane rubber or silicone rubber or a material having metal elasticity such as phosphor bronze and stainless steel. This elastic control blade 511 is characterized in that the blade is pressed against the development sleeve 508 in the direction opposite to the rotational direction of the sleeve in the development apparatus illustrated in FIG. 2.

Because a thin layer of the developer is formed on the development sleeve by elastically pressing the developer layer thickness control member against the development sleeve 508 through the developer layer, a thinner developer layer than in the above case of FIG. 1 can be formed on the development sleeve 508.

FIG. 2 shows a development apparatus for a nonmagnetic one-component developer that is used as a toner 504, where because of the nonmagnetism of the toner there are no magnets in the development sleeve and a solid metal rod 514 is used as the sleeve. The non-magnetic toner is charged by friction with one of the layer thickness control blade 511 and a sleeve coat layer 517 and is carried on the surface of the development sleeve 508 for conveyance.

The other basic constitution in the development apparatus illustrated in FIG. 2 is the same as that of the development apparatus illustrated in FIG. 1, and the same reference numerals basically represent the same members.

Figure 3:
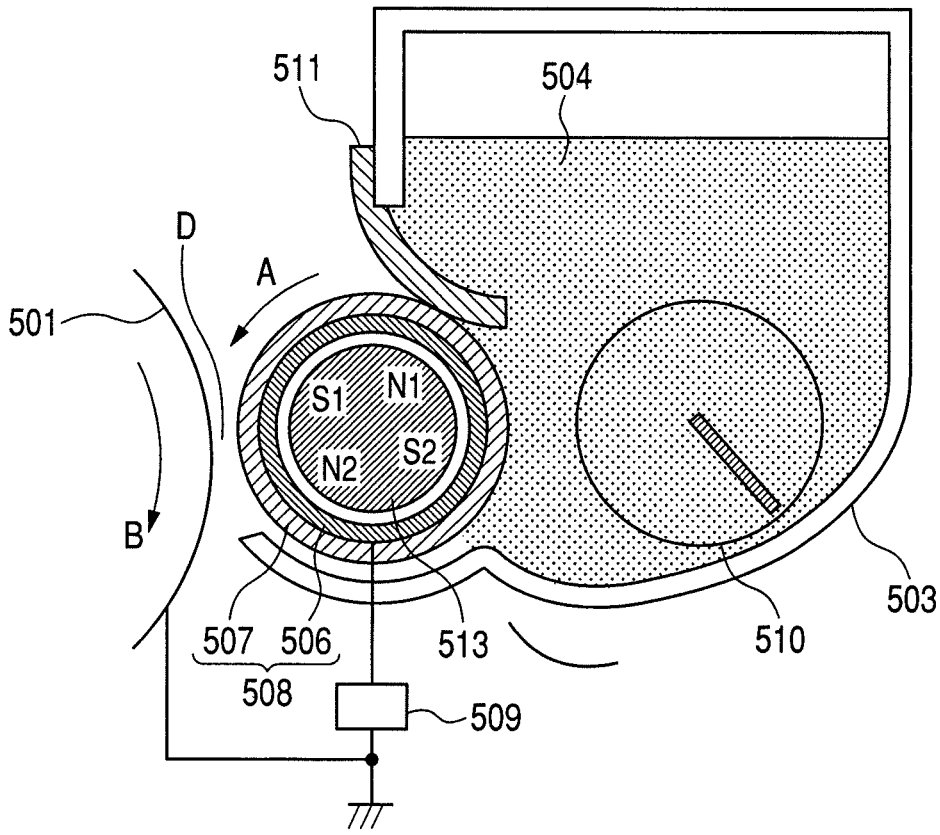
FIG. 3 is a schematic view of an example of a development apparatus used in the development method of the present invention.
Figure 4:
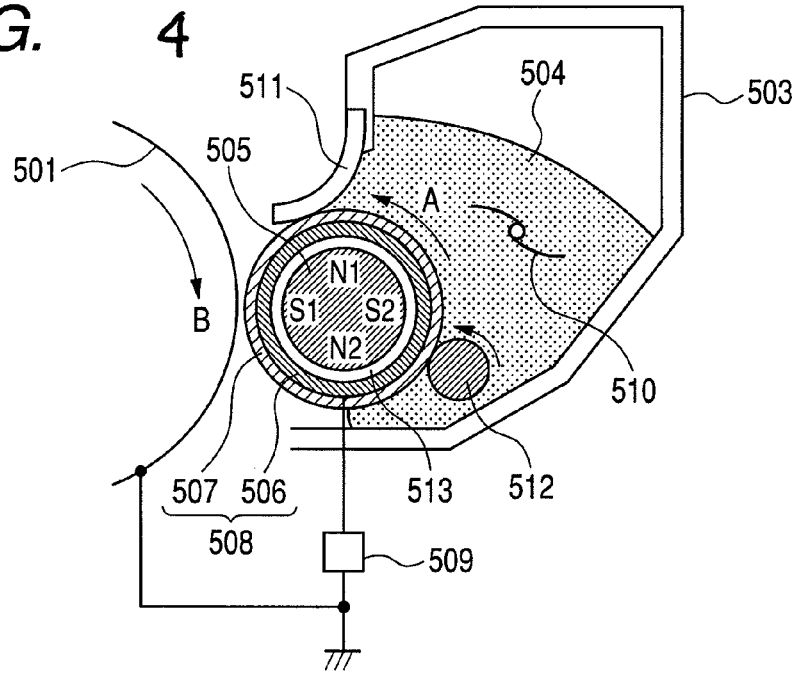
FIG. 4 is a schematic view of an example of a development apparatus used in the development method of the present invention.

FIGS. 3 and 4 are schematic sectional views of the constitutions having an elastic control member in a development apparatus using a magnetic toner. FIGS. 1 to 4 only schematically exemplify the development apparatus of the present invention, and the shape of the developer container (hopper 503), the presence or absence of stirring blade 510, and the arrangement of magnetic poles may be expressed in various forms.

Next, the developer (toner) used in a development apparatus into which the developer bearing member of the present invention is incorporated will be described.

The toner of the present invention can be produced by a pulverization method or a polymerization method. If the toner is produced by a pulverization method, a known method may be used. For example, a binding resin, a magnetic material, a release agent, a charge control agent, and components optionally required as a magnetic toner such as a colorant, other additives and the like are thoroughly mixed by using a mixer such as a Henschel mixer, a ball mill or the like. Then, a hot kneader such as a heating roll, a kneader or an extruder may be used to melt and knead the mixture, cool and solidify the kneaded product, pulverize the solidified product, classify the milled product, and optionally subject the classified product to surface treatment to obtain toner particles. Either classification or surface treatment may come first. In the classification step, a multisegment classifier is preferably used for higher productivity. The pulverization step can be conducted by a known pulverizing apparatus of a type such as a mechanical impact-type or a jet pulverization-type.

When such toner particles are subjected to spherical treatment or surface smoothening treatment by various methods and is then used, it is observed that the toner particles encapsulate a magnetic substance more easily than pulverized toner particles, thus improving developer transferability and thereby enabling the amount of developer consumed to be reduced. Such methods include a method in which when a developer is passed through the very small gap between the blade and the liner, the toner particles are smoothened in their surfaces or made spherical by mechanical force in an apparatus having a stirring impeller, blade or the like and a liner, a casing or the like.

In addition, an example of a method of directly producing a toner with particles made spherical is a method in which a mixture containing mainly a monomer that is to be a toner binding resin is suspended in water and polymerized to produce a toner. A common method is as follows. A polymerizable monomer, a colorant and a polymerization initiator, and further as needed a crosslinker, a charge control agent, a release agent and other additives are uniformly dissolved or dispersed to prepare a monomer composition. Then, this monomer composition is dispersed to an appropriate particle size with an appropriate stirrer in a dispersion stabilizer-containing continuous layer, such as an aqueous phase, and further polymerized to obtain a developer having the desired particle size.

It is preferable that in toner particles having a high sphericity which are preferably used, particles having an circle-equivalent diameter of 3 μm or more and 400 μm or less as measured with a flow particle image analyzer have an average circularity of 0.970 or more. This is because such a high average circularity makes it easy for the surface of individual toner particles to be uniformly charged by friction, providing excellent charging uniformity.

Toner particles having such a high sphericity generally have a large quantity of charge and a too large quantity of charge can cause charge-up depending on the circumstances of use. Especially, the developer bearing member used in the present invention can maintain the ability to impart an appropriate charge to such toner particles having a high sphericity, and such an ability can last long, so the developer bearing member can be further preferably used in combination with such a toner having a high sphericity.

In addition, the toner used in the present invention preferably has a weight-average particle size of 3 μm to 10 μm for higher image quality, namely, for faithfully developing finer latent image dots. A toner having a weight-average particle size of less than 3 μm provides a large amount of toner remaining on the photosensitive member after transfer because of the decreased transfer efficiency, making it difficult to suppress photosensitive member scraping and toner fusion in the contact charging step. Moreover, such a toner increases the surface area of the whole toner, and besides, decreases flow properties and stirring properties as a powder and makes it difficult to uniformly charge individual toner particles, with the result that fogging is liable to occur and transferability is liable to deteriorate, tending to cause image unevenness in addition to scraping and fusion. Moreover, a weight-average particle size of greater than 10 μm is liable to cause scattering to occur on characters and line images, making it difficult to obtain high resolution.

Furthermore, it is preferable to include a sulfur-containing resin as a polar polymer charge control agent in a developer (toner particles) usable in the present invention because the resin is very compatible with other components and allows for uniform charging. Among the sulfur-containing resins, a sulfur-containing resin preferably has especially at least a constituent unit derived from sulfonic acid group-containing (meth)acrylamide when the resin is used with the developer bearing member of the present invention, in view of the fact that uniform and high chargeability can be achieved and excess charging can be suppressed. Especially, constituent units derived from 2-acrylamide-2-methylpropanesulfonic acid and derived from 2-methacrylamide-2-methylpropanesulfonic acid are preferable in view of charging properties.

In addition, the sulfur-containing resin may be a copolymer of a sulfur-containing monomer and another monomer. As monomers that form a copolymer with the sulfur-containing monomer, monofunctional polymerizable monomers and polyfunctional polymerizable monomers can be used. Examples of monofunctional polymerizable monomers include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methylacrylate, ethylacrylate, n-propylacrylate, iso-propylacrylate, n-butylacrylate, iso-butylacrylate, tert-butylacrylate, n-amylacrylate, n-hexylacrylate, 2-ethylhexylacrylate, n-octylacrylate, n-nonylacrylate, cyclohexylacrylate, benzylacrylate, dimethylphosphate ethylacrylate, diethylphosphate ethylacrylate, dibutylphosphate ethylacrylate and 2-benzoyloxyethylacrylate; methacrylic polymerizable monomers such as methylmethacrylate, ethylmethacrylate, n-propylmethacrylate, iso-propylmethacrylate, n-butylmethacrylate, iso-butylmethacrylate, tert-butylmethacrylate, n-amylmethacrylate, n-hexylmethacrylate, 2-ethylhexylmethacrylate, n-octylmethacrylate, n-nonylmethacrylate, cyclohexylmethacrylate, benzylmethacrylate, dimethylphosphate ethylmethacrylate, diethylphosphate ethylmethacrylate and dibutylphosphate ethylmethacrylate; methylene aliphatic monocarboxylic acid esters; vinyl esters such as vinyl acetate, vinyl propionate, vinyl butyrate, vinyl benzoate and vinyl formate; vinyl ethers such as vinyl methyl ether, vinyl ethyl ether and vinyl isobutyl ether; vinyl ketones such as vinyl methyl ketone, vinyl hexyl ketone and vinyl isopropyl ketone.

Examples of polyfunctional polymerizable monomers include polyfunctional acrylic polymerizable monomers such as ethylene glycol diacrylate, diethylene glycol diacrylate, triethylene glycol diacrylate, tetraethylene glycol diacrylate, polyethylene glycol diacrylate, 1,3-butylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, 2,2'-bis(4-(acryloxypolyethoxy)phenyl)propane, trimethylolpropane triacrylate and tetramethylolmethane tetraacrylate; polyfunctional acrylic polymerizable monomers such as ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentylglycol dimethacrylate, tripropylene glycol dimethacrylate, polypropylene glycol dimethacrylate, 2,2'-bis(4-(methacryloxydiethoxy)phenyl) propane, 2,2'-bis(4-(methacryloxypolyethoxy)phenyl)propane, trimethylolpropane trimethacrylate and tetramethylolmethane tetramethacrylate; and divinyl monomers such as divinylbenzene, divinylnaphthalene and divinyl ether.

The monomers above can be used as a resin having a constituent unit derived from sulfonic acid group-containing (meth)acrylamide, and such a resin more preferably contains a styrene derivative as a monomer.

A process for producing a resin having a constituent unit derived from a sulfonic acid group-containing (meth)acrylamide monomer may be any one of bulk polymerization, solution polymerization, emulsion polymerization, suspension polymerization, ionic polymerization, dispersion polymerization and the like. Solution polymerization is preferable because it provides easy production and can uniformly mix sulfonic acid group-containing monomers.

A resin having a constituent unit derived from a sulfonic acid group-containing (meth)acrylamide monomer has a structure represented by the general formula (3) below:

$$XCONHR^{23}(SO_3^-)_n \cdot mY^{+k} \quad (3)$$

(wherein, X represents a polymer site derived from a polymerizable monomer; $R^{23}$ represents a hydrocarbon group having 1 to 6 carbon atoms and a valence of (n+1); $Y^+$ represents a counter ion; k represents the valence of the counter ion; and m and n represent numbers satisfying n=k×m.)

The counter ion is preferably a hydrogen cation, a sodium cation, a potassium cation, a calcium cation, an ammonium cation, or the like, and more preferably a hydrogen cation.

In addition, since the resin having a constituent unit derived from sulfonic acid group-containing (meth)acrylamide has a high polarity, when the resin is included in toner particles, the charge-transfer rate increases when the toner particles are charged by friction, enabling charge-up at low humidity and a decrease in the quantity of charge at high humidity to be prevented.

This sulfur-containing resin is preferably a polymer compound composed of a copolymer containing 2% to 20% by mass of a constituent unit derived from a sulfonic acid group-containing (meth)acrylamide-based monomer in the resin. If the copolymer percentage of the sulfonic acid group-containing (meth)acrylamide-based monomer in the sulfur-containing resin is less than 2% by mass, charge rising occurs and the output of a solid image especially in the initial stage of the use of the developing roller may cause a ghost image to appear. In addition, if the copolymer percentage exceeds 20% by mass, even when the amount of the sulfur-containing resin contained in the toner particles is reduced, toner charge-up occurs, and especially in a low-temperature and low-humidity environment, fogging becomes more significant and blotches appear in some cases.

In addition, the amount of this sulfur-containing resin added is preferably 0.1 parts by mass to 1.8 parts by mass with respect to 100 parts by mass of the binding resin in toner particles in view of the charging performance of toner particles. If the amount of the sulfur-containing resin added exceeds 1.8 parts by mass with respect to 100 parts by mass of the binding resin in the toner, the charge-up phenomenon is liable to occur, and if the amount added is less than 0.1 parts by mass, the quantity of charge is difficult to raise and necessary and adequate charge controlling effect cannot be obtained in some cases.

To obtain the good charging performance of toner particles, it is considered to be important that a charge control agent including a resin containing a constituent unit derived from sulfonic acid group-containing (meth)acrylamide at a specific ratio is included in toner particles at a specific ratio. The content of the resin having a sulfonate group in a toner can be measured by capillary electrophoresis or the like.

In addition, the sulfur-containing resin preferably has a weight-average molecular weight (Mw) of 2,000 to 15,000. When the molecular weight is low, namely, Mw is less than 2,000, the flow properties of the toner is liable to deteriorate, and especially during continuous use, the degradation of the toner may occur due to the embedding of external additives. In addition, when Mw is greater than 15,000, the dispersibility of the iron oxide in the toner particles is lowered and thus can degrade the electrostatic charging performance and reduce the coloring power.

The molecular weight of a resin can be measured by gel permeation chromatography (GPC). A sample for test is prepared by extracting a resin with tetrahydrofuran (THF) in a Soxhlet extractor for 20 hours. The column constitution is set to connect, for example, A-801, 802, 803, 804, 805, 806 and 807 (all trade names) from Showa Denko K.K., and a calibration curve of a reference polystyrene resin is used to measure the molecular weight distribution.

Moreover, the frictional charge quantity of the toner with respect to iron powder is preferably −80 mC/kg or more and −25 mC/kg or less. The iron powder in this case is a spherical iron powder carrier passing through a 100-mesh sieve and retained on a 200-mesh sieve (trade name, Spherical Iron Powder DSP138), and the measurement method is as described later. If the frictional charge quantity is −25 mC/kg or more, the toner has a sufficient friction charge quantity, making it difficult to cause a decrease in image density, deterioration in image quality and the like. In addition, such an amount is more preferable because it can further reduce the influence of temperature and humidity and a decrease in image density due to environmental variations. When the frictional charge quantity is set at −80 mC/kg or less, the occurrence of blotches caused by an excess frictional charge quantity is suppressed, enabling good images to be obtained, so such an amount is more preferable.

Next, methods of measuring physical properties associated with the present invention will be described below:

(1) Measurement of the Arithmetic Average Roughness (Ra) of the Developer Bearing Member Surface The arithmetic average roughness (Ra) of the developer bearing member surface was measured with Surfcorder SE-3500 manufactured by Kosaka Laboratory Ltd. according to the surface roughness defined in JIS B0601 (2001) under the measurement conditions: cut off, 0.8 mm; evaluation length, 8 mm; and feed speed, 0.5 mm/s. Measurement was made at 9 spots in total: three spots (the center, the portion between that center and one end of the developer bearing member and the portion between that center and the other end of the developer bearing member), those three spots after the developer bearing member is rotated by 90°, and those three spots after rotation of the developer bearing member is rotated by additional 90°, and the resulting values were averaged.

(2) Measurement of the Volume Resistance of the Electrically Conductive Resin Coating Layer of a Developer Bearing Member A 7-μm to 20-μm thick coating layer was formed on a 100-μm-thick polyethylene terephthalate (PET) sheet to measure the volume resistance with the resistivity meter Rolesta AP (available from Mitsubishi Chemical Corporation) by using a 4-point probe. Measurement was made under the conditions: temperature, 20 to 25° C.; and humidity, 50 to 60% RH.

(3) The Degree of Graphitization p(002) of Graphitized Particles

The degree of graphitization p(002) was determined by measuring the lattice spacing d(002) obtained from X-ray diffraction spectra of a graphite with a high-power fully-automatic X-ray diffractometers "MXP18" system (trade name) available from Bruker AXS K.K. and substituting the measured value into the equation d(002)=3.440−0.086(1−P2). Here, in measuring the lattice spacing d(002), CuK α-radiation was used as the X-ray source and CuK β-radiation was removed with a nickel filter. High-purity silicon was used as the reference material, the lattice spacing was calculated from the peak positions on C(002) and Si(111) diffraction patterns. The major measurement conditions are as follows.

X-ray generator: 18 kW;
Goniometer: Horizontal goniometer;
Monochromator: Used;
Tube voltage: 30.0 kV; tube current: 10.0 mA;
Measurement method: Continuous method;

Scan axis: 2θ/θ;
Sampling interval: 0.020 deg;
Scan speed: 6.000 deg/min;
Divergence slit: 0.50 deg; scattering slit: 0.50 deg; and
Light receiving slit: 0.30 mm.

(4) Measurement of the True Density of Spherical Particles

The true density of spherical particles used in the present invention was measured with a dry densitometer (trade name, Accupyc 1330; from Shimadzu Corporation).

(5) Measurement of the Particle Sizes of Electrically Conductive Particles and Particles in a Coating Solution The particle sizes of electrically conductive particles and particles in a coating solution were measured with the laser diffraction particle size analyzer Coulter LS-230 Particle Size Analyzer (trade name; available from Beckman Coulter K.K.). Measurements are made by using Small Volume Module and isopropyl alcohol (IPA) as the measurement solvent. The interior of the measuring system of the particle size analyzer is washed with IPA for about 5 minutes, and then the background function is brought into action. Next, 1 mg of the measurement sample is added to 50 mL of IPA. The solution in which the sample is suspended is subjected to dispersion treatment with an ultrasonic disperser for about 1 minute to prepare a sample solution. Then, the sample solution is gradually added into the measuring system of the measuring apparatus and the sample concentration in the measuring system is adjusted so that PIDS on the screen of the apparatus is 45% to 55%, to thereby obtain the volume-average particle size calculated from the volume distribution.

(6) Measurement of the Particle Size of Electrically Conductive Fine Particles Having a Particle Diameter of Less Than 1 μm An electron microscope is used to measure the particle size of electrically conductive fine particles. Particles are photographed at 50,000 magnifications, but if it is difficult, after particles are photographed at a low magnification, the resulting picture is so enlarged as to be at 50,000 magnifications, and is printed. On the picture, the particle sizes of the primary particles are measured. Then, the major axis and minor axis are measured and the measured values are averaged to determine the particle size. This procedure is repeated for 100 samples and the 50% value is defined as the average particle size.

(7) Measurement of the Ratios of the Major Axes to the Minor Axes of Spherical Particles The ratio is measured with an electron microscope in the same way as above. In this case, the major axis and minor axis are measured and the ratio between them is calculated. This procedure is repeated for 100 samples and the 50% value is defined as the ratio of the major axis to the minor axis.

(8) Measurement of the Volume Resistivity of Electrically Conductive Fine Particles Particles are placed in a 40-mm-diameter aluminum ring and subjected to pressure molding under a pressure of 2,500 N. The volume resistance is measured with the resistivity meter Rolesta AP (trade name; available from Mitsubishi Chemical Corporation) by using a 4-point probe in the low resistance region and with Hiresta IP (trade name; available from Mitsubishi Chemical Corporation) by using a ring electrode probe in the middle and high resistance region. Here, the measurement is made in an environment of 20 to 25° C. and 50 to 60% RH.

(9) Measurement of the Particle Size of a Toner

As the measuring apparatus, Coulter Multisizer II (trade name; available from Beckman Coulter K.K.) is used. As the electrolytic solution, about 1% NaCl aqueous solution is prepared by using first class sodium chloride. As the dispersing agent, 0.5 mL of a surfactant, preferably alkylbenzene sulfonate, is added to 100 mL of the electrolytic aqueous solution, to which 10 mg of the measurement sample is further added. The electrolytic solution in which the sample is suspended is subjected to dispersion treatment with an ultrasonic dispersing device for about 1 minute. The volume and the number of particles of the measurement sample were measured with the measuring apparatus by using 100-μm Aperture or 30-μm Aperture as the aperture to calculate the volume distribution and the particle number distribution. From these results, the weight-average particle size ($D_4$) (the median for each channel is defined as the representative value for the channel) based on weight, calculated from the volume distribution, was determined.

(10) The Average Circularity of Toner Particles

The average circularity in the present invention is used as a convenient method of quantitatively representing the shape of particles. In the present invention, the flow particle image analyzer FPIA-1000 (trade name, available from Sysmex Corporation) is used for measurement. Measurements were made on a group of particles having a circle-equivalent diameter of 3 μm or more to calculate the circularity (Ci) of each of the measured particles by using the equation below:

Circularity (Ci)=Circumferential length of a circle having the same projected area as a particle image/Circumferential length of the projected image of the particle)

Moreover, as shown in the equation below, the total of the circularities of all particles measured is divided by the number of all particles, and the value thus obtained is defined as the average circularity.

$$\text{Average circularity} = \sum_{i=1}^{m} ci/m \qquad \text{(Expression 1)}$$

The average circularity in the present invention is an indicator indicating the irregularity degree of particles. A perfectly round particle has a circularity of 1.000, and the more complex the surface shape of the developer, the lower the average circularity is.

Specifically, measurement is made as follows. About 5 mg of a developer is dispersed in 10 mL of water in which about 0.1 mg of a surfactant is dissolved to prepare a dispersion solution, to which ultrasonic waves (20 kHz, 50 W) are then applied for 5 minutes. The concentration of the dispersion solution was set to be from 5,000 particles/μL to 200,000 particles/μL and measurements were made with the analyzer to determine the average circularity of particles having a circle-equivalent diameter of 3 μm or more.

The outline of the measurement is described in, for example, the FPIA-1000 (trade name) catalog (June 1995 edition) and the manual for the analyzer issued by Sysmex Corporation and is as below:

The sample dispersion solution is passed through the channel (extending in the direction of flow) of a flat flow cell (about 200 μm thick). To form an optical path that intersects and passes through the thickness of the flow cell, a strobe and a CCD camera are provided so that they are located on the sides opposite to each other with respect to the flow cell. While the sample dispersion solution flows, it is irradiated with strobe light at intervals of 1/30 second to obtain an image of a particle flowing through the flow cell, and as a result, each particle is photographed as a two-dimensional image having a certain range parallel to the flow cell. The area of the two-dimensional image of each particle is used to calculate the diameter of a circle having the same area as the area of the two-dimensional image to determine the circle-equivalent diameter. The projected area of the two-dimensional image and the circumference of the projected image of each particle are used to calculate the circularity of the particle from the above circularity calculation equation.

The reason why circularity is measured only for a group of particles having a circle-equivalent diameter of 3 μm or more is as follows. Groups of particles of external additives present independently of toner particles are included in large amounts in a group of particles having a circle-equivalent diameter less than 3 μm, whereby the circularity of a group of toner particles is prevented from being accurately estimated.

(11) Measurement of the Quantity of Charge of a toner

Figure 5:
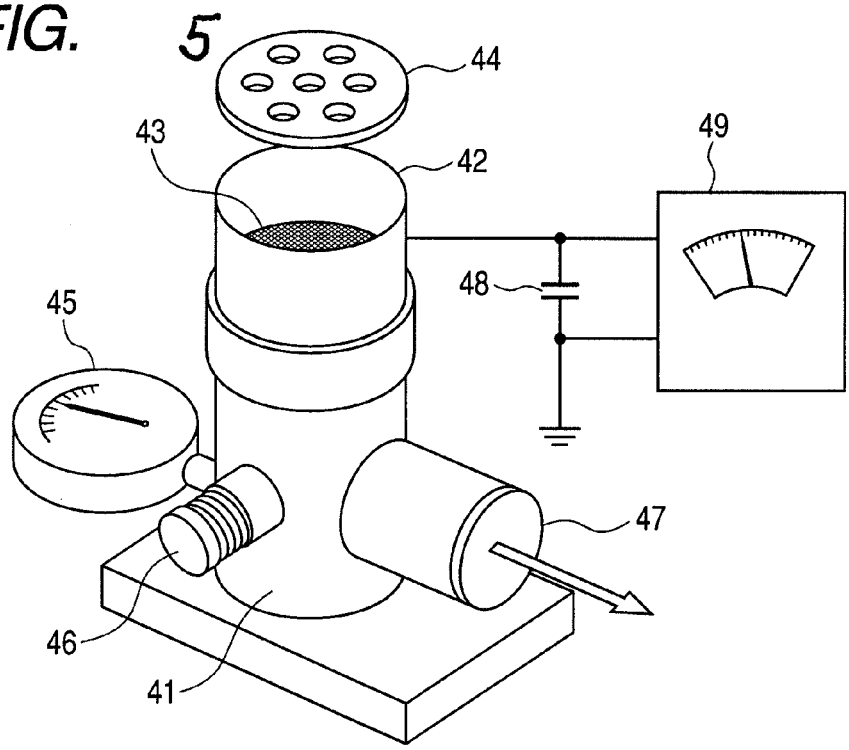
FIG. 5 is a schematic view of an apparatus to measure the quantity of frictional charge on a developer.

The electrostatic charge measuring apparatus illustrated in FIG. 5 was used for measurement. First, 0.5 g of a toner left standing overnight or more in an environment of 23° C. and 60% RH along with 9.5 g of a spherical iron powder carrier passing through a 100-mesh sieve and retained on a 200-mesh sieve is placed in a 50- to 100-mL polyethylene bottle. As the spherical iron powder carrier, Spherical Iron Powder DSP138 (trade name) was used. This bottle was placed on a shaker having a constant amplitude and shaken for a specific time under the conditions: amplitude, 100 mm; and shaking speed, 100 cycles per minute.

Next, 1.0 to 1.2 g of the above mixture is placed in a metal measurement container 42 having a 500-mesh screen 43 at the bottom thereof included in a charge quantity measuring apparatus 41, and a metal lid 44 is placed on the container. The mass of the whole measurement container 42 at this time is defined as a weight W1 (g) Then, a sucker (the portion coming into contact with the measurement container 42 is at least electrically insulated) not illustrated in the figure is used to suck air through a suction opening 47 and an air flow rate control valve 46 is adjusted so that a vacuum gage 45 indicates a pressure of 2,450 Pa (250 mmAq). One minute of suction is conducted in this state to suck and remove the toner. The potential indicated by an electrometer 49 at this time is defined as V (volts). Here, reference number 48 denotes a capacitor and its capacity is defined as C (μF). In addition, the mass of the whole measuring apparatus after suction is defined as a weight W2 (g). Their measured values are used to calculate the charge by friction of the toner (μC/g) from the equation below:

$$\text{Charge by friction (mC/kg)} = C \times V/(W1 - W2)$$

EXAMPLES

The present invention will be specifically described below by using Production Examples and Examples, but the present invention is not limited thereto.

Developer Production Example 1

To a pressurizable reaction vessel provided with a reflux tube, a stirrer, a thermometer, a nitrogen inlet tube, a dropping device, and a decompressor, 250 parts by mass of methanol, 150 parts by mass of 2-butanone and 100 parts by mass of 2-propanol were added as the solvents. Moreover, 83 parts by mass of styrene, 12 parts by mass of butyl acrylate and 4 parts by mass of 2-acrylamido-2-methylpropane sulfonic acid were added to the reaction vessel as the monomers, and the mixture was heated to the reflux temperature under stirring. A solution prepared by diluting 0.45 parts by mass of t-butylperoxy-2-ethylhexanoate, a polymerization initiator with 20 parts by mass of 2-butanone was dropped over 30 minutes and stirring was continued for 5 hours. Moreover, a solution prepared by diluting 0.28 parts by mass of t-butylperoxy-2-ethylhexanoate with 20 parts by mass of 2-butanone was dropped over 30 minutes and stirring was carried out for further 5 hours for polymerization. Then, the reaction solution was placed in methanol to precipitate sulfonic acid group-containing polymer S. The resulting polymer S had a glass transition temperature (Tg) of 70.4° C. and a weight-average molecular weight of 23,000.

1.0 equivalent of a solution of caustic soda with respect to iron ions was added in an aqueous solution of ferrous sulfate to prepare an aqueous solution containing ferrous hydroxide. Air was blown into this aqueous solution while the pH of the aqueous solution was maintained at about 9, and the aqueous solution was subjected to oxidation reaction for 90 seconds to prepare a slurry solution for producing seed crystals. Next, the aqueous solution of ferrous sulfate was added to this slurry solution so that the slurry solution came to be 1.0 equivalent with respect to the initial alkali content (sodium component of caustic soda), then while the pH of the slurry solution was maintained at 8, air was blown into the slurry solution to cause the oxidation reaction to proceed. The magnetic particles produced after the oxidation reaction were washed and filtered and then temporarily taken out. At this time, a water-containing sample was collected in a small amount to measure the amount of water contained. Next, this water-containing sample was redispersed in a different aqueous medium without being dried, then the pH of the redispersion solution was adjusted to about 6, and to the resulting solution, 2 parts of a silane coupling agent ($n\text{-}C_9H_{17}Si(OCH_3)_3$) with respect to 100 parts of magnetic iron oxide (the amount of the magnetic substance was calculated by subtracting the amount of water contained from the water-containing sample) was added under thorough stirring, followed by coupling treatment. According to conventional methods, the magnetic particles produced were washed, filtered and dried, then particles somewhat agglomerated were subjected to disintegration treatment to produce a surface-treated magnetic substance-1 having an average particle size of 0.20 μm and a hydrophobic degree of 83.

Next, the following materials were uniformly dispersed and mixed together by means of an attritor (available from Nippon Coke & Engineering Co., Ltd.).

Styrene: 78 parts by mass;
n-Butyl acrylate: 22 parts by mass;
Divinylbenzene: 0.5 parts by mass;
Saturated polyester resin (acid value, 8; peak molecular weight [Mp], 12,000): 2 parts by mass;
Sulfonic acid group-containing polymer S: 1.6 parts by mass; and
Surface-treated magnetic substance-1: 88 parts by mass.

This mixture was heated to 60° C., and 7 parts by mass of ester wax (maximum in the endothermic peak in the DSC curve, 72° C.) was added to, mixed with, and dissolved in the mixture, and 3 parts by mass of 2,2-azobis(2,4-dimethylvaleronitrile) as a polymerization initiator was dissolved therein to prepare a polymerizable monomer composition.

On the other hand, 451 parts by mass of a 0.1 M $Na_3PO_4$ aqueous solution was placed in 709 parts by mass of ion exchanged water, which then heated to 60° C., and thereafter, 67.7 parts by mass of a 1.0 M $CaCl_2$ aqueous solution was added to prepare an aqueous medium containing $Ca_3(PO_4)_2$. The polymerizable monomer composition was placed in this aqueous medium and was stirred by means of T.K. Homo Mixer (available from PRIMIX Corporation) at 10,000 rpm for 15 minutes in a 60° C. $N_2$ atmosphere, thereby being granulated. After that, the aqueous medium was allowed to react at 70° C. for 5 hours while being stirred by means of a paddle stirring impeller. Thereafter, while the solution temperature was maintained at 80° C., stirring was continued for further 4 hours. After the reaction was completed, distillation was carried out at 80° C. for further 2 hours, then the resulting suspension was cooled, hydrochloric acid was added thereto to dissolve the dispersing agent, and the resultant was filtered, washed and dried to produce black particles having a weight-average particle size of 7.5 μm.

100 parts by mass of these black particles and 1.2 parts by mass of a hydrophobic silica fine powder were mixed by means of a Henschel mixer (available Nippon Coke & Engineering Co., Ltd.) to produce a magnetic developer T-1 having a weight-average particle size of 7.4 μm and an average circularity of 0.988. As the hydrophobic silica fine powder, a hydrophobic silica fine powder having a BET specific surface area of 120 $m^2/g$ obtained by treating a silica having a primary particle size of 12 nm with hexamethyldisilazane followed by with silicone oil was used. The frictional charge quantity of the developer T-1 due to friction with an iron powder was −31.5 mC/kg.

Developer Production Example 2

3 parts by mass of tricalcium phosphate was added to 900 parts by mass of ion exchanged water heated to 60° C., and the mixture was stirred by means of T.K. Homo Mixer (available from PRIMIX Corporation) at 10,000 rpm to prepare an aqueous medium. In addition, the following materials were placed in a homogenizer (available from Nippon Seiki Co., Ltd.), heated to 60° C., stirred at 9,000 rpm, dissolved and dispersed.

Styrene: 150 parts by mass;
n-Butyl acrylate: 50 parts by mass;
C. I. pigment blue 15:3: 18 parts by mass;
Aluminum salicylate compound (available from Orient Chemical Industries Co., Ltd.; trade name, BONTRON E-88): 2 parts by mass;
Polyester resin (polycondensate of propylene oxide-modified bisphenol A and isophthalic acid; Tg, 65° C.; Mw, 10,000; Mn, 6,000): 15 parts by mass;
Stearyl stearate wax (main peak in the DSC curve, 60° C.): 30 parts by mass; and
Divinylbenzene: 0.6 parts by mass.

In this mixture, 5 parts by mass of 2,2'-azobis(2,4-dimethylvaleronitrile) as a polymerization initiator was dissolved to prepare a polymerizable monomer composition. In the aqueous medium, the polymerizable monomer composition was placed and the resulting mixture was stirred at 8,000 rpm by means of T.K. Homo Mixer in a 60° C. nitrogen atmosphere, thereby being granulated. Then, the resulting product was placed in a propeller stirrer, heated to 70° C. over 2 hours under stirring, and after further 4 hours, heated to 80° C. at a temperature rise rate of 40° C./hr, allowed to react at 80° C. for 5 hours to produce polymer particles A. After the polymerization reaction was completed, the slurry containing the particles A was cooled, washed with the amount of water 10 times the amount of the slurry, filtered and dried, then the particle size was adjusted by classification to thereby obtain base particles for cyan toner (weight-average particle size, 7.0 μm; average circularity, 0.981).

To 100 parts by mass of these toner particles, the following materials were dry-added and stirred for 5 minutes by means of a Henschel mixer (from Nippon Coke & Engineering Co., Ltd.) to produce a non-magnetic one-component developer T-2 having a weight-average particle size of 6.9 μm and an average circularity of 0.981.

Hydrophobic silica fine powder surface-treated with hexamethylene disilazane (average primary particle size, 7 nm): 1.0 parts by mass;
Rutile titanium dioxide fine powder (average primary particle size, 45 nm): 0.15 parts by mass; and
Rutile titanium dioxide fine powder (average primary particle size, 200 nm): 0.5 parts by mass.

The frictional charge quantity of the developer T-2 due to friction with an iron powder was −77.5 mC/kg.

Developer Production Example 3

The polymer particles A obtained in developer Production Example 2 was filtered off and dried, then the particle size was adjusted to a weight-average particle size of 5.9 μm by classification to produce base particles for cyan toner (average circularity, 0.989).

To 100 parts by mass of these toner particles, the following materials were dry-added and stirred for 5 minutes by means of a Henschel mixer (from Nippon Coke & Engineering Co., Ltd.) to produce a non-magnetic one-component developer T-3 having a weight-average particle size of 5.8 μm and an average circularity of 0.989.

Hydrophobic silica fine powder surface-treated with hexamethylene disilazane (average primary particle size, 7 nm): 1.2 parts by mass;
Rutile titanium dioxide fine powder (average primary particle size, 45 nm): 0.15 parts by mass; and
Rutile titanium dioxide fine powder (average primary particle size, 200 nm): 0.5 parts by mass.

The frictional charge quantity of the developer T-3 due to friction with an iron powder was −88.4 mC/kg.

Developer Production Example 4

180 parts by mass of water in which 0.8 parts by mass of a partially saponified product of polyvinyl alcohol was dissolved was added to a mixture of the following materials, and was vigorously stirred to prepare a suspended dispersion solution.

Styrene: 73.5 parts by mass;
n-Butyl acrylate: 19 parts by mass;
Monobutyl maleate: 7 parts by mass;
Divinylbenzene: 0.5 parts by mass;
Benzoyl peroxide: 1 parts by mass; and
Di-t-butylperoxy-2-ethylhexanoate: 0.5 parts by mass.

This suspended dispersion solution was placed in a reaction vessel in which 40 parts by mass of water had been placed and the atmosphere had been replaced with nitrogen, and subjected to suspension polymerization at a reaction temperature of 85° C. for 10 hours. After the reaction was completed, the resulting product was filtered off, washed with water, dewatered and dried to produce a vinyl-based resin.

A mixture of the following materials was kneaded by using a twin-screw kneading extruder heated to 130° C.

Vinyl-based resin above: 100 parts by mass;
Spherical magnetic substance having an average particle size of 0.2 μm: 90 parts by mass;
Azo-type iron complex compound (negatively chargeable charge control agent available from Hodogaya Chemical Co., Ltd.; trade name, T-77): 2 parts by mass;
Low-molecular-weight ethylene-propylene copolymer: 5 parts by mass; and
Magnetic iron oxide (average particle size, 0.2 μm; coercive force, 11.2 kA/m; residual magnetization, 8.8 $Am^2/kg$; saturation magnetization, 80.3 $Am^2/kg$): 90 parts by mass.

The resulting kneaded product was cooled, then coarsely ground with a hammer mill, and further, pulverized with a pulverizing mill using a jet stream. The pulverized powder was classified by means of a multisegment classifier using the Coanda effect to remove super fine powder and coarse powder at the same time to thereby produce toner particles having a weight-average particle size (D4) of 7.5 μm.

To 100 parts by mass of the toner particles, the following materials were added and stirred by means of a Henschel mixer to produce a negatively chargeable magnetic one-component developer T-4 having a weight-average particle size of 7.3 μm and an average circularity of 0.958.

Negatively chargeable hydrophobic silica fine particles treated with hexamethyldisilazane (BET, 300 $m^2/g$): 0.9 parts by mass; and Strontium titanate: 3 parts by mass.

The frictional charge quantity of the developer T-4 due to friction with an iron powder was −21.5 mC/kg.

Table 2 shows the properties of the developers.

Example 1

β-resin was extracted from coal tar pitch by solvent fractionation, hydrogenated and polymerized, and then the solvent-soluble fraction was removed with toluene to produce mesophase pitch. This mesophase pitch powder was pulverized, and the pulverized powder was oxidized in air at about 300° C., heat-treated in an nitrogen atmosphere at 2,800° C. and classified to produce graphitized particles A having a volume-average particle size of 3.4 μm and a degree of graphitization p(002) of 0.39.

Next, the following materials were mixed together and dispersed for 2 hours by means of a sand mill using 1-mm-diameter glass beads as media particles to produce a coating material intermediate M1.

Resol-type phenolic resin P1 using an ammonia catalyst (available from DIC Corporation; trade name, J325): 50 parts by mass (in terms of solid content);

Electrically conductive carbon black (Columbia Carbon Corp.; trade name, Conductex 975): 12.5 parts by mass;

Graphitized particles A: 37.5 parts by mass; and

Methanol: 37.5 parts by mass.

Moreover, the following materials were mixed together and dispersed for 45 minutes by means a sand mill using 2-mm-diameter glass beads as media particles to produce a coating material intermediate J1.

Resol-type phenolic resin P1: 50 parts by mass (in terms of solid content);

Quaternary phosphonium salt 1, compound 1 exemplified in Table 1 (available from Nippon Chemical Industrial Co. Ltd.; trade name, HISHICOLIN BTPPBr): 20 parts by mass;

Electrically conductive spherical particles (available from Nippon Carbon Co., Ltd.; trade name, Nicabeads PC0520): 25 parts by mass; and Methanol: 37.5 parts by mass.

Then, the coating material intermediate M1 and the coating material intermediate J1 were mixed together in the mass ratio of 1:1 and stirred to prepare a coating solution B1.

Next, methanol was added to this coating solution B1 to adjust the solid content to 38% by mass. A cylindrical aluminum tube subjected to grinding, having an outer diameter of 10 mmϕ and an arithmetic average roughness Ra of 0.2 μm was stood on a turntable and rotated, both ends thereof were masked, and while an air spray gun was lowered at a constant speed, the coating solution B1 was applied to the surface of the cylindrical tube to form an electrically conductive resin coating layer. The coating solution was adjusted to a temperature of 28° C. in a constant temperature bath and applied in an environment in which the temperature was 30° C. and the humidity was 35% RH. Subsequently, the electrically conductive resin coating layer was heated at 150° C. for 30 minutes in a hot-air drying furnace for curing to prepare a developer bearing member S-1 having Ra of 1.05 μm. Table 3 shows the formulation and physical properties of the electrically conductive resin coating layer of the developer bearing member (development sleeve) S-1.

To evaluate this developer bearing member S-1, a commercially available laser-beam printer (available from Hewlett-Packard Development Company, L.P.; trade name, LaserJet P1505n) and a genuine cartridge thereof were used. A magnet and a flange were attached to the developer bearing member S-1 so that the carrier could be fit to the cartridge, the developer bearing member was set in this cartridge, in which the developer (toner) T-1 was then placed to evaluate images with the laser-beam printer. In the evaluation, a character pattern having a printing rate of 1% was output on 3,000 sheets as a Durability Evaluation test, which, in the Tables, is abbreviated to "D.E.T.") in an intermittent mode at a rate of 1 sheet per 7 seconds, and evaluation was made on the following items (1) to (4) in a 15° C./10% RH low-temperature/low humidity (L/L) environment, a 23° C./50% RH normal temperature/normal humidity (N/N) environment and a 30° C./85% RH high temperature/high humidity (H/H) environment. The results are shown in Table 4 and indicate consistent good developability in all the environments.

(1) Image Density

Image density was evaluated by outputting a solid image in the initial stage and in the terminal stage of the durability evaluation test, and measuring the image density thereof. In the measurement of image density, a Macbeth reflection densitometer, RD-918, (trade name; from GretagMacbeth AG) was used to measure the relative density with respect to the image of a white background portion having an original density of 0.00.

A: 1.40 or more (Excellent);

B: 1.35 or more and less than 1.40 (Good);

C: 1.00 or more and less than 1.35 (Somewhat low image density); and

D: Less than 1.00 (Low image density).

(2) Ghosts

A pattern was used in which solid black pictographic images (images of a square, a circle and the like) were arranged on a white background at regular intervals across a region at the tip of the image output by the printer, with the region corresponding to one rotation of the developer bearing member, and the other portions were made halftone. The images were ranked according to how ghosts of the pictographic images appeared on the halftone.

A: No difference in density is observed;

B: A slight difference in density is observed depending on an angle at which the image is observed;

C: A ghost is clearly observed; and

D: A ghost appears as a difference in density. A difference in density corresponding to two or more rotations of the developer bearing member is observed.

(3) Image Unevenness

Halftone and solid black images were output, and evaluation was made on blotchy (spotted, ruffle-like or carpet-like) images which are liable to occur due to excess charging of the toner and on image density unevenness caused by non-uniform charging of the toner according to the following criteria.

A: No difference in density is observed on the halftone images and on the sleeve;

B: A slight difference in density is observed on the halftone images, but hardly observed at first glance;

C: A difference in density is observed on the halftone images, but not on the solid black images; and D: A difference in density is clearly observed on the halftone images and also on the solid black images.

(4) Fogging

The reflectance of a solid white image on an appropriate image was measured, and further, the reflectance of unused transfer paper was measured, and "(the minimum value of the reflectance of the solid white image)−(the average value of the reflectance of unused transfer paper)" was defined as fogging density. Evaluation was made according to the criteria below. In this case, the reflectance was measured randomly at 10 spots by means of TC-6DS (trade name; available from Tokyo Denshoku Co., Ltd.).

A: Less than 1.0% (No fogging is observed);

B: 1.0% or more and less than 2.0% (No fogging is observed unless the image is closely observed);

C: 2.0% or more and less than 3.0% (Fogging is observed); and

D: 3.0% or more (Fogging is clearly observed).

Example 2

A coating solution was prepared in the same way as in Example 1 except that the amount of a quaternary phosphonium salt 1 was changed to 60 parts by mass and the amount of electrically conductive spherical particles was changed to 30 parts by mass. Then, in the same way as in Example 1, coating was conducted to prepare and evaluate a developer bearing member S-2.

Example 3

A coating solution was prepared in the same way as in Example 1 except that the amount of a quaternary phosphonium salt 1 was changed to 1 part by mass and the amount of electrically conductive spherical particles was changed to 40 parts by mass. Then, in the same way as in Example 1, coating was conducted to prepare and evaluate a developer bearing member S-3.

Example 4

A coating solution was prepared in the same way as in Example 1 except that a quaternary phosphonium salt 2 (available from Nippon Chemical Industrial Co., Ltd.; trade name, HISHICOLIN PX-4B), the compound 16 exemplified in Table 1, was used instead of the quaternary phosphonium salt 1. Then, in the same way as in Example 1, coating was conducted to prepare and evaluate a developer bearing member S-4.

Example 5

A coating solution was prepared in the same way as in Example 1 except that a quaternary phosphonium salt 3 (available from Tokyo Chemical Industry Co., Ltd.; trade name, Benzyltriphenylphosphonium Bromide), the compound 4 exemplified in Table 1, was used instead of the quaternary phosphonium salt 1. The, in the same way as in Example 1, coating was conducted to prepare and evaluate a developer bearing member S-5.

Example 6

A coating solution was prepared in the same way as in Example 1 except that a quaternary phosphonium salt 4 (available from Nippon Chemical Industrial Co., Ltd.; trade name, PX-2H), the compound 9 exemplified in Table 1, was used instead of the quaternary phosphonium salt 1. Then, in the same way as in Example 1, coating was conducted to prepare and evaluate a developer bearing member S-6.

Example 7

A coating solution was prepared in the same way as in Example 1 except that a resol-type phenolic resin P2 (using an amine compound catalyst; available from Gun Ei Chemical Industry Co., Ltd.; trade name, PL-4852) was used instead of the resol-type phenolic resin P1. Then, in the same way as in Example 1, coating was conducted to prepare and evaluate a developer bearing member S-7.

Example 8

A coating solution was prepared in the same way as in Example 1 except that a resol-type phenolic resin P3 (using an amine compound catalyst; available from Showa Highpolymer Co., Ltd.; trade name, BKS-316) was used instead of the resol-type phenolic resin P1. Then, in the same way as in Example 1, coating was conducted to prepare and evaluate a developer bearing member S-8.

Example 9

A coating solution was prepared in the same way as in Example 1 except that the amount of the carbon black was changed to 40 parts by mass and the graphitized particles A was not added. Then, in the same way as in Example 1, coating was conducted to prepare and evaluate a developer bearing member S-9.

Example 10

A coating solution was prepared in the same way as in Example 1 except that the amount of the graphitized particles was changed to 50 parts by mass and the carbon black was not added. Then, in the same way as in Example 1, coating was conducted to prepare and evaluate a developer bearing member S-10.

Example 11

A coating solution was prepared in the same way as in Example 1 except that the amount of the electrically conductive carbon black was changed to 10 parts by mass and 70 parts by mass of a titanium oxide (available from Ishihara Sangyo Kaisha, Ltd.; trade name, TIPAQUE CR-50) was used instead of the graphitized particles A. Then, in the same way as in Example 1, coating was conducted to prepare and evaluate a developer bearing member S-11.

Example 12

A coating solution was prepared in the same way as in Example 1 except that a crystalline graphite (available from Showa Denko K.K.; trade name, UF-G5) was used instead of the graphitized particles A. Then, in the same way as in Example 1, coating was conducted to prepare and evaluate a developer bearing member S-12.

Comparative Example 1

A coating solution was prepared in the same way as in Example 1 except that a resol-type phenolic resin P4 (using an NaOH catalyst; available from DIC Corporation; trade name, GF-9000) was used instead of the phenolic resin P1. Then, in the same way as in Example 1, coating was conducted to prepare and evaluate a developer bearing member J-1.

Comparative Example 2

A coating solution was prepared in the same way as in Example 1 except that a resol-type phenolic resin P5 (using an NaOH catalyst; available from DIC Corporation; trade name, TD-244LV) was used instead of the resol-type phenolic resin P1 of Example 1. Then, in the same way as in Example 1, coating was conducted to prepare and evaluate a developer bearing member J-2.

Comparative Example 3

A coating solution was prepared in the same way as in Example 4 except that a resol-type phenolic resin P4 (using an NaOH catalyst; from DIC Corporation; trade name, GF-9000) was used instead of the resol-type phenolic resin P1. Then, in the same way as in Example 4, coating was conducted to prepare and evaluate a developer bearing member J-3.

Comparative Example 4

A coating solution was prepared in the same way as in Example 1 except that an azo-type iron complex compound (available from Hodogaya Chemical Co., Ltd.; trade name, T-77) was used instead of the quaternary phosphonium salt 1. Then, in the same way as in Example 1, coating was conducted to prepare and evaluate a developer bearing member J-4.

Comparative Example 5

A coating solution was prepared in the same way as in Example 1 except that the quaternary phosphonium salt 1 was not used. Then, in the same way as in Example 1, coating was conducted to prepare and evaluate a developer bearing member J-5.

Comparative Example 6

A coating solution was prepared in the same way as in Example 1 except that the graphitized particles A, the electrically conductive carbon black and the quaternary phosphonium salt 1 were not used. Then, in the same way as in Example 1, coating was conducted to prepare and evaluate a developer bearing member J-6.

Example 13

25 parts by mass (in terms of solid content) of the resol-type phenolic resin P1, 22.5 parts by mass of the quaternary phosphonium salt 2 and 37.5 parts by mass of methanol were added in the coating material intermediate M1 in Example 1 and was stirred to prepare a coating solution C1.

Next, methanol was added to this coating solution C1 to adjust the solid content to 38% by mass. A cylindrical aluminum tube subjected to grinding, having an outer diameter of 12 mmϕ and Ra of 0.2 μm was stood on a turntable and rotated, both ends thereof were masked, and while an air spray gun was lowered at a constant speed, the coating solution C1 was applied to the surface of the cylindrical tube and was cured to form an electrically conductive resin coating layer, thereby preparing a developer bearing member S-13 having Ra of 1.06 μm. The coating and drying conditions were made the same as with the developer bearing member (development sleeve) S-1.

The resulting developer bearing member S-13 was set in a genuine cyan cartridge for a commercially available laser-beam printer (available from Canon Inc.; trade name, LBP5000) and further, the cartridge was filled with the developer (toner) T-2 to prepare a development apparatus. This development apparatus was set in the laser-beam printer and then a character pattern having a printing rate of 5% was output on 3,000 sheets as a durability evaluation test in an intermittent mode at a rate of 1 sheet/10 seconds, and evaluation was made on the items (1) and (4) as above and the item (5) as below in a 15° C./10% RH low temperature/low humidity (L/L) environment, a 23° C./50% RH normal temperature/normal humidity (N/N) environment, and a 30° C./85% RH high temperature/high humidity (H/H) environment. The results are shown in Table 5 and indicate consistent good developability in all the environments.

(5) Image Quality

Image evaluation was made on toner scattering around fine lines associated with the quality of graphical images. Specifically, an image of single dot lines around which toner scattering was more liable to occur as compared with character lines was printed and the printed image was magnified 30 times with a magnifying glass and evaluated on line reproducibility and toner scattering around the lines.

A: Almost no scattering occurs and good line reproducibility is indicated;

B: Slight scattering is observed;

C: Scattering is observed, but has a little effect on line reproducibility; and

D: Significant scattering is observed and line reproducibility is poor.

Example 14

A coating solution was prepared in the same way as in Example 13 except that a quaternary phosphonium salt 5 (available from Nippon Chemical Industrial Co., Ltd.; trade name, HISHICOLIN PX-4BT) represented by the formula below was used instead of the quaternary phosphonium salt 2. Then, in the same way as in Example 13, coating was conducted to prepare and evaluate a developer bearing member S-14.

Formula 3

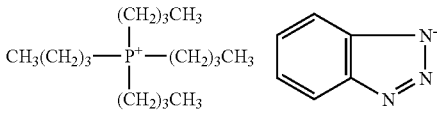

Example 15

A coating solution was prepared in the same way as in Example 13 except that a resol-type phenolic resin P2 (using an amine compound catalyst; available from Gun Ei Chemical Industry Co., Ltd.; trade name, PL-4852) was used instead of the resol-type phenolic resin P1. Then, in the same way as in Example 13, coating was conducted to prepare and evaluate a developer bearing member S-15.

Example 16

Evaluation was made in the same way as in Example 13 except that the toner T-3 was used instead of the developer T-2.

Example 17

Evaluation was made in the same way as in Example 14 except that the toner T-3 was used instead of the developer T-2.

Comparative Example 7

A coating solution was prepared in the same way as in Example 13 except that a resol-type phenolic resin P4 (using an NaOH catalyst; DIC Corporation; trade name, GF-9000) was used instead of the resol-type phenolic resin P1. Then, in the same way as in Example 13, coating was conducted to prepare and evaluate a developer bearing member J-7.

Comparative Example 8

A coating solution was prepared in the same way as in Example 13 except that the amount of quaternary phosphonium salt 2 was changed to 0.75 parts by mass. Then, in the same way as in Example 13, coating was conducted to prepare and evaluate a developer bearing member J-8.

Comparative Example 9

Evaluation was made in the same way as in Comparative Example 7 except that the developer T-3 was used instead of the developer T-2.

Comparative Example 10

Evaluation was made in the same way as in Comparative Example 8 except that the toner T-3 was used instead of the developer T-2.

Example 18

The following materials were mixed together and dispersed for 45 minutes by means of a sand mill using 2-mm-diameter glass beads as media particles to prepare a coating material intermediate J18.

Resol-type phenolic resin P1: 25 parts by mass (in terms of solid content);

Quaternary phosphonium salt 1: 3.75 parts by mass;

Electrically conductive spherical particles 2 (available from Nippon Carbon Co., Ltd.; trade name, Nicabeads PC1020): 10 parts by mass; and Methanol: 37.5 parts by mass.

This coating material intermediate J18 and the coating material intermediate M1 in Example 1 were mixed together in the mass ratio of 1:1 and stirred to prepare a coating solution D1.

Next, methanol was added to this coating solution D1 to adjust the solid content to 34% by mass. A cylindrical aluminum tube subjected to grinding, having an outer diameter of 14 mmϕ and Ra of 0.2 μm was stood on a turntable and rotated, both ends thereof were masked, and while an air spray gun was lowered at a constant speed, the coating solution D1 was applied to the surface of the cylindrical tube to form an electrically conductive resin coating layer. Coating was conducted in a 30° C./35% RH environment with the temperature of the coating solution controlled at 28° C. in a constant temperature bath. Subsequently, the electrically conductive resin coating layer was heated at 150° C. for 30 minutes in a hot-air drying furnace for curing to prepare a developer bearing member S-16 having Ra of 1.34 μm. Table 3 shows the formulation and physical properties of the electrically conductive resin coating layer of the developer bearing member (development sleeve) S-16.

To evaluate this developer bearing member S-16, a genuine cartridge for a commercial available laser-beam printer (from Hewlett-Packard Development Company, L.P.; trade name, LaserJet P2015d) was used. A magnet and a flange were attached to the developer bearing member S-16 so that the carrier could be fit to the cartridge, the developer bearing member was set in this cartridge, in which the developer T-3 was then placed to evaluate images with the laser-beam printer. In the evaluation, a character pattern having a printing rate of 2% was output on 10,000 sheets as a durability evaluation test in an intermittent mode at a rate of 1 sheet/4 seconds, and evaluation was made on the items (1) to (3) and (5) as above in a 15° C./10% RH low-temperature/low humidity (L/L) environment, a 23° C./50% RH normal temperature/normal humidity (N/N) environment, and a 30° C./85% RH high temperature/high humidity (H/H) environment. The results are shown in Table 6 and indicate consistent good developability in all the environments.

Example 19

A coating solution was prepared in the same way as in Example 18 except that the amount of quaternary phosphonium salt 1 was changed to 0.75 parts by mass and the amount of electrically conductive spherical particles added was changed to 12 parts by mass. Then, in the same way as in Example 18, coating was conducted to prepare and evaluate a developer bearing member S-17.

Example 20

A coating solution was prepared in the same way as in Example 18 except that the quaternary phosphonium salt 1 was changed to the quaternary phosphonium salt 5. Then, in the same way as in Example 18, coating was conducted to prepare and evaluate a developer bearing member S-18.

Comparative Example 11

A coating solution was prepared in the same way as in Example 18 except that a resol-type phenolic resin P5 (using an NaOH catalyst; available from DIC Corporation; trade name, TD-244LV) was used instead of the resol-type phenolic resin P1. Then, in the same way as in Example 18, coating was conducted to prepare and evaluate a developer bearing member J-9.

Comparative Example 12

A coating solution was prepared in the same way as in Example 18 except that the amount of quaternary phosphonium salt 1 was changed to 50 parts by mass and the amount of electrically conductive spherical particles was changed to 35 parts by mass. Then, in the same way as in Example 18, coating was conducted to prepare and evaluate a developer bearing member J-10.

Example 21

Methanol was added to the coating solution B1 of Example 1 to adjust the solid content to 38% by mass, and the viscosity measured in a 23° C./50% RH normal temperature/normal humidity environment was 50 mPa·s. The coating material viscosity was measured with a B-type viscometer under the conditions: No. 1 rotor rotational speed, 60 rpm; and measurement time, 30 seconds. In the coating solution B1, the volume resistivity was 2.38 Ω·cm and the volume-average particle size was 2.12 μm. Next, this coating solution B1 was left standing in a 40° C. environment for 20 days and taken out, and then defined as B1'. The viscosity of this B1' measured in a 23° C./50% RH normal temperature/normal humidity environment was 55 mPa·s, which was almost the same as the viscosity before the coating solution was left standing. In addition, the volume resistance and volume-average particle size measured in the same way were 2.66 Ω·cm and 2.19 μm, respectively, which remained almost unchanged from those before the coating solution was left standing. Table 7 shows a list of the coating solutions and Table 8 shows the physical properties of the coating solutions.

Next, 300 cylindrical aluminum tubes subjected to grinding, having an outer diameter of 10 mmϕ and Ra of 0.2 μm were stood on a turntable and rotated, both ends thereof were masked, and while an air spray gun was lowered at a constant speed, this B1' was continuously applied to the surface of the cylindrical tubes. Coating was conducted in a 30° C./35% RH environment with the temperature of the coating solution controlled at 28° C. in a constant temperature bath. In addition, the electrically conductive resin coating layer was heated at 150° C. for 30 minutes in a hot-air drying furnace for curing. These continuously coated samples were visually checked, samples having seediness defects were extracted, the sizes of the defects were checked with a microscope and the defects were evaluated in the following way.

(6) Presence or Absence of Seediness Defects

Continuously coated samples were visually checked and the rate of occurrence (%, rounded off to the nearest integer) of seediness defects was calculated. In addition, samples having seediness defects were extracted and the sizes of the defects were checked under a microscope.

A: The rate of occurrence of seediness defects is 1% or less and all the sizes of the defects are less than 50 μm;

B: The rate of occurrence of seediness defects is 2 to 9% and all the sizes of the defects are less than 50 μm. Alternatively, the rate of occurrence of seediness defects is 9% or less and the rate of occurrence of seediness defects having a size of 50 μm or more and less than 100 μm is in the range of 1% or less;

C: The rate of occurrence of seediness defects is 10 to 19% and all the sizes of the defects are less than 50 μm, or the rate of occurrence of seediness defects having a size of 50 μm or more and less than 100 μm is in the range of 1% or less. Alternatively, the rate of occurrence of seediness defects is 19% or less and the rate of occurrence of seediness defects having a size of 50 μm or more and less than 100 μm is in the range of 2% to 9%. Alternatively, the rate of occurrence of seediness defects is 19% or less and the rate of occurrence of seediness defects having a size of 100 μm or more is in the range of 1% or less; and D: The rate of occurrence of seediness defects is 20% or more. Alternatively, the rate of occurrence of seediness defects having a size of 50 μm or more and less than 100 μm is 10% or more. Alternatively, the rate of occurrence of seediness defects having a size of 100 μm or more is 2% or more.

Next, 50 samples coated with B1' were extracted and subjected to the following initial evaluation using a commercially available laser-beam printer (available from Hewlett-Packard Development Company, L.P.; trade name, LaserJet P1505n) and a cartridge thereof in the same way as in Example 1.

(7) Image Defects

Halftone images were output in the initial stage of image output, and evaluation was made on image defects such as sleeve pitch white spot images and vertical streak images caused by sleeve coating seediness, according to the criteria below.

A: No image defects can be observed on all the samples;

B: The rate of samples having only one white spot that can be visually observed is less than 4%. However, there is no sample having a plurality of white spots, and there is no sample having vertical streaks;

C: There is a sample having only one vertical streak that can be visually observed. Alternatively, the rate of samples having only one white spot that can be visually observed is less than 4% or more and less than 10%. However, there is no sample having a plurality of white spots or vertical streaks that can be observed; and D: There is a sample having a plurality of white spots or vertical streaks that can be visually observed. Alternatively, the rate of samples having only one white spot that can be visually observed is 10% or more.

In addition, a sample coated with B1' was defined as S-19, and images were output and evaluated in the same way as in Example 1. The results of the evaluations above are shown in Table 9. These results were good.

Example 22

The coating solution in Example 4 was defined as B2, the coating solution was left standing in a 40° C. environment for 20 days, then taken out and was defined as B2'. A sample coated with B2' was defined as S-20, which was evaluated in the same way as in Example 21.

Example 23

The coating solution in Example 6 was defined as B3, the coating solution was left standing in a 40° C. environment for 20 days, then taken out and was defined as B3'. A sample coated with B3' was defined as S-21, which was evaluated in the same way as in Example 21.

Comparative Example 13

A coating solution B4 was prepared in the same way as in Example 1 except that a quaternary ammonium salt compound (available from Japan Carlit Co., Ltd.; trade name, A-902) was used instead of the quaternary phosphonium salt 1. Then, the coating solution was left standing in a 40° C. environment for 20 days, then taken out and was defined as B4'. A sample coated with B4' was defined as J-11, which was evaluated in the same way as in Example 21.

Comparative Example 14

The coating solution in Comparative Example 1 was defined as B5, the coating solution was left standing in a 40° C. environment for 20 days, then taken out and was defined as B5'. A sample coated with B5' was defined as J-12, which was evaluated in the same way as in Example 21.

Comparative Example 15

The coating solution in Comparative Example 4 was defined as B6, the coating solution was left standing in a 40° C. environment for 20 days, then taken out and was defined as B6'. A sample coated with B6' was defined as J-13, which was evaluated in the same way as in Example 21.

TABLE 2

| List of properties of developers | | |
|---|---|---|
| | Average circularity | Quantity of charge by friction with iron powder (mC/kg) |
| T-1 | 0.988 | −31.5 |
| T-2 | 0.981 | −77.5 |

TABLE 2-continued

| List of properties of developers | | |
|---|---|---|
| | Average circularity | Quantity of charge by friction with iron powder (mC/kg) |
| T-3 | 0.989 | −88.4 |
| T-4 | 0.958 | −21.5 |

TABLE 3

| List of properties of developer bearing members | | | | | | | | | | | |
|---|---|---|---|---|---|---|---|---|---|---|---|
| | Electrically conductive fine particles 1 | Parts added | Electrically conductive fine particles 2 | Parts added | Phenolic resin | Parts added | Quaternary phosphonium salt | Parts added | Electrically conductive spherical particles | Parts added | Ra (μm) |
| S-1 | Carbon black | 12.5 | Graphitized particles A | 37.5 | P1 | 100 | 1 | 20 | 1 | 25 | 1.05 |
| S-2 | ↑ | ↑ | ↑ | ↑ | ↑ | ↑ | ↑ | 60 | ↑ | 30 | 1.25 |
| S-3 | ↑ | ↑ | ↑ | ↑ | ↑ | ↑ | ↑ | 1 | ↑ | 20 | 0.93 |
| S-4 | ↑ | ↑ | ↑ | ↑ | ↑ | ↑ | 2 | 20 | ↑ | 25 | 1.04 |
| S-5 | ↑ | ↑ | ↑ | ↑ | ↑ | ↑ | 3 | ↑ | ↑ | ↑ | 1.06 |
| S-6 | ↑ | ↑ | ↑ | ↑ | ↑ | ↑ | 4 | ↑ | ↑ | ↑ | 1.05 |
| S-7 | ↑ | ↑ | ↑ | ↑ | P2 | ↑ | 1 | ↑ | ↑ | ↑ | 1.08 |
| S-8 | ↑ | ↑ | ↑ | ↑ | P3 | ↑ | ↑ | ↑ | ↑ | ↑ | 1.07 |
| S-9 | ↑ | 40 | | | P1 | ↑ | ↑ | ↑ | ↑ | ↑ | 0.99 |
| S-10 | | | Graphitized particles A | 50 | ↑ | ↑ | ↑ | ↑ | ↑ | ↑ | 1.07 |
| S-11 | ↑ | 10 | Titanium oxide | 70 | P1 | ↑ | ↑ | ↑ | ↑ | ↑ | 1.05 |
| S-12 | ↑ | 12.5 | Crystalline graphite | 37.5 | ↑ | ↑ | ↑ | ↑ | ↑ | ↑ | 1.03 |
| J-1 | Carbon black | 12.5 | Graphitized particles A | 37.5 | P4 | 100 | 1 | 20 | 1 | 25 | 1.06 |
| J-2 | ↑ | ↑ | ↑ | ↑ | P5 | ↑ | ↑ | ↑ | ↑ | ↑ | 1.09 |
| J-3 | ↑ | ↑ | ↑ | ↑ | P4 | ↑ | 2 | ↑ | ↑ | ↑ | 1.07 |
| J-4 | ↑ | ↑ | ↑ | ↑ | P1 | ↑ | Azo-type iron complex compound | ↑ | ↑ | ↑ | 1.09 |
| J-5 | ↑ | ↑ | ↑ | ↑ | ↑ | ↑ | No | | ↑ | ↑ | 1.05 |
| J-6 | No | | No | | ↑ | ↑ | No | | ↑ | ↑ | 0.98 |
| S-13 | Carbon black | 12.5 | Graphitized particles A | 37.5 | P1 | 75 | 2 | 22.5 | No | | 0.48 |
| S-14 | ↑ | ↑ | ↑ | ↑ | ↑ | ↑ | 5 | ↑ | ↑ | | 0.51 |
| S-15 | ↑ | ↑ | ↑ | ↑ | P2 | ↑ | 2 | ↑ | ↑ | | 0.53 |
| J-7 | Carbon black | 12.5 | Graphitized particles A | 37.5 | P4 | 75 | 2 | 22.5 | No | | 0.52 |
| J-8 | ↑ | ↑ | ↑ | ↑ | P1 | ↑ | ↑ | 0.5 | ↑ | | 0.51 |
| S-16 | Carbon black | 12.5 | Graphitized particles A | 37.5 | P1 | 75 | 1 | 3.75 | 2 | 10 | 1.34 |
| S-17 | ↑ | ↑ | ↑ | ↑ | ↑ | ↑ | ↑ | 0.75 | ↑ | 10 | 1.17 |
| S-18 | ↑ | ↑ | ↑ | ↑ | ↑ | ↑ | 5 | 3.75 | ↑ | 10 | 1.37 |
| J-9 | Carbon black | 12.5 | Graphitized particles A | 37.5 | P5 | 75 | 1 | 3.75 | 2 | 10 | 1.32 |
| J-10 | ↑ | ↑ | ↑ | ↑ | P1 | ↑ | ↑ | 50 | ↑ | 35 | 1.68 |
| S-19 | Carbon black | 12.5 | Graphitized particles A | 37.5 | P1 | 100 | 1 | 20 | 1 | 25 | 1.06 |
| S-20 | ↑ | ↑ | ↑ | ↑ | ↑ | ↑ | 2 | ↑ | ↑ | ↑ | 1.05 |
| S-21 | ↑ | ↑ | ↑ | ↑ | ↑ | ↑ | 4 | ↑ | ↑ | ↑ | 1.07 |
| J-11 | Carbon black | 12.5 | Graphitized particles A | 37.5 | P1 | 100 | Quaternary ammonium salt | 20 | 1 | 25 | 1.08 |
| J-12 | ↑ | ↑ | ↑ | ↑ | P4 | ↑ | 1 | ↑ | ↑ | ↑ | 1.11 |
| J-13 | ↑ | ↑ | ↑ | ↑ | P1 | ↑ | Azo-type iron complex compound | ↑ | ↑ | ↑ | 1.09 |

TABLE 4

| Evaluation results of developer T-1 | | | | | | | | | | | |
|---|---|---|---|---|---|---|---|---|---|---|---|
| | Developer | | | Image density | | Ghost | | Image unevenness | | Fogging | |
| | bearing member | Developer | Environment | Initial | After D.E.T. | Initial | After D.E.T. | Initial | After D.E.T. | Initial | After D.E.T. |
| Ex. 1 | S-1 | T-1 | H/H | A | A | B | A | A | A | A | A |
| | | | N/N | A | A | A | A | A | A | A | A |
| | | | L/L | A | A | A | A | A | A | A | A |
| Ex. 2 | S-2 | ↑ | H/H | A | C | C | B | A | A | A | C |
| | | | N/N | A | B | B | A | A | A | A | A |
| | | | L/L | A | A | B | A | A | A | A | A |
| Ex. 3 | S-3 | ↑ | H/H | A | A | B | B | A | A | B | A |
| | | | N/N | A | A | C | A | A | A | A | A |
| | | | L/L | A | B | B | A | B | A | A | A |

TABLE 4-continued

Evaluation results of developer T-1

| | Developer bearing member | Developer | Environment | Image density | | Ghost | | Image unevenness | | Fogging | |
|---|---|---|---|---|---|---|---|---|---|---|---|
| | | | | Initial | After D.E.T. | Initial | After D.E.T. | Initial | After D.E.T. | Initial | After D.E.T. |
| Ex. 4 | S-4 | ↑ | H/H | A | A | B | A | A | A | A | A |
| | | | N/N | A | A | B | A | A | A | A | A |
| | | | L/L | A | A | B | A | A | A | A | A |
| Ex. 5 | S-5 | ↑ | H/H | A | A | B | A | A | A | A | A |
| | | | N/N | A | A | A | A | A | A | A | A |
| | | | L/L | A | A | A | A | A | A | A | A |
| Ex. 6 | S-6 | ↑ | H/H | A | A | B | A | A | A | A | A |
| | | | N/N | A | C | A | B | A | B | A | B |
| | | | L/L | A | C | B | C | A | C | A | C |
| Ex. 7 | S-7 | ↑ | H/H | A | B | B | A | A | A | A | B |
| | | | N/N | A | A | B | A | A | A | A | B |
| | | | L/L | A | A | A | A | B | A | A | A |
| Ex. 8 | S-8 | ↑ | H/H | A | B | B | A | A | A | A | B |
| | | | N/N | A | A | B | A | A | B | A | B |
| | | | L/L | A | A | A | A | B | A | A | A |
| Ex. 9 | S-9 | ↑ | H/H | A | B | C | B | A | A | A | B |
| | | | N/N | A | A | B | A | A | B | A | B |
| | | | L/L | A | B | B | A | B | A | A | B |
| Ex. 10 | S-10 | ↑ | H/H | A | A | B | A | A | A | A | B |
| | | | N/N | A | A | A | A | A | A | A | A |
| | | | L/L | A | B | B | A | B | A | A | B |
| Ex. 11 | S-11 | ↑ | H/H | A | B | B | B | A | A | A | B |
| | | | N/N | A | A | A | A | A | A | A | B |
| | | | L/L | A | B | A | A | A | B | B | A |
| Ex. 12 | S-12 | ↑ | H/H | A | B | B | B | A | A | A | B |
| | | | N/N | A | A | A | A | A | A | A | B |
| | | | L/L | A | A | A | A | A | B | A | A |
| Com. Ex. 1 | J-1 | ↑ | H/H | A | A | D | C | B | A | B | A |
| | | | N/N | A | B | C | B | B | B | B | A |
| | | | L/L | A | D | B | B | D | B | C | B |
| Com. Ex. 2 | J-2 | ↑ | H/H | A | A | D | D | A | A | B | A |
| | | | N/N | A | B | C | B | B | A | B | A |
| | | | L/L | A | D | B | A | D | C | D | B |
| Com. Ex. 3 | J-3 | ↑ | H/H | A | A | D | D | A | A | B | B |
| | | | N/N | A | A | C | B | B | B | B | A |
| | | | L/L | A | D | B | A | D | C | C | B |
| Com. Ex. 4 | J-4 | ↑ | H/H | A | A | C | B | A | A | B | A |
| | | | N/N | A | B | C | B | B | A | B | B |
| | | | L/L | A | B | C | A | C | B | B | B |
| Com. Ex. 5 | J-5 | ↑ | H/H | A | A | C | B | A | A | B | A |
| | | | N/N | A | A | C | A | B | A | B | A |
| | | | L/L | A | C | C | A | C | A | B | B |
| Com. Ex. 6 | J-6 | ↑ | H/H | B | B | D | D | C | B | D | B |
| | | | N/N | B | C | D | C | C | B | B | C |
| | | | L/L | B | D | D | C | D | D | D | C |

TABLE 5

Evaluation results of developers T-2 and T-3

| | Developer bearing member | Developer | Environment | Image density | | Fogging | | Image quality | |
|---|---|---|---|---|---|---|---|---|---|
| | | | | Initial | After D.E.T. | Initial | After D.E.T. p. | Initial | After D.E.T. |
| Ex. 13 | S-13 | T-2 | H/H | A | B | B | B | A | B |
| | | | N/N | A | A | B | B | A | B |
| | | | L/L | A | A | B | B | A | B |
| Ex. 14 | S-14 | ↑ | H/H | A | B | B | B | A | B |
| | | | N/N | A | A | B | B | A | B |
| | | | L/L | A | A | B | B | A | B |
| Ex. 15 | S-15 | ↑ | H/H | A | B | B | B | A | B |
| | | | N/N | A | A | B | B | A | B |
| | | | L/L | A | A | B | C | A | B |
| Ex. 16 | S-13 | T-3 | H/H | A | B | B | B | A | B |
| | | | N/N | A | A | B | B | A | B |
| | | | L/L | A | A | B | C | A | B |

TABLE 5-continued

Evaluation results of developers T-2 and T-3

| | Developer bearing member | Developer | Environment | Image density Initial | Image density After D.E.T. | Fogging Initial | Fogging After D.E.T. p. | Image quality Initial | Image quality After D.E.T. |
|---|---|---|---|---|---|---|---|---|---|
| Ex. 17 | S-14 | ↑ | H/H | A | B | B | B | A | B |
| | | | N/N | A | A | B | C | A | B |
| | | | L/L | A | A | B | C | A | B |
| Com. Ex. 7 | J-7 | T-2 | H/H | A | D | B | B | B | D |
| | | | N/N | A | B | B | B | B | C |
| | | | L/L | A | B | C | D | A | B |
| Com. Ex. 8 | J-8 | ↑ | H/H | A | C | B | B | B | C |
| | | | N/N | A | B | B | B | A | B |
| | | | L/L | A | B | B | C | A | B |
| Com. Ex. 9 | J-7 | T-3 | H/H | A | D | B | C | B | D |
| | | | N/N | A | C | B | C | B | D |
| | | | L/L | A | C | C | D | A | D |
| Com. Ex. 10 | J-8 | ↑ | H/H | A | C | B | B | B | D |
| | | | N/N | A | B | B | C | A | C |
| | | | L/L | A | B | B | D | A | B |

TABLE 6

Evaluation results of developer T-4

| | Developer bearing member | Developer | Environment | Image density Initial | Image density After D.E.T. | Ghost Initial | Ghost After D.E.T. | Image unevenness Initial | Image unevenness After D.E.T. | Image quality Initial | Image quality After D.E.T. |
|---|---|---|---|---|---|---|---|---|---|---|---|
| Ex. 18 | S-16 | T-4 | H/H | A | B | A | B | A | A | B | B |
| | | | N/N | A | B | A | B | A | A | A | B |
| | | | L/L | A | A | B | A | A | A | A | A |
| Ex. 19 | S-17 | ↑ | H/H | A | B | A | B | A | A | A | B |
| | | | N/N | A | A | B | A | A | A | A | B |
| | | | L/L | A | A | C | A | A | B | A | B |
| Ex. 20 | S-18 | ↑ | H/H | A | B | A | B | A | A | B | C |
| | | | N/N | A | B | A | B | A | A | A | B |
| | | | L/L | A | B | B | B | A | B | A | B |
| Com. Ex. 11 | J-9 | ↑ | H/H | A | B | B | B | A | A | A | B |
| | | | N/N | A | A | C | B | A | B | A | C |
| | | | L/L | A | A | D | C | B | D | B | D |
| Com. Ex. 12 | J-10 | ↑ | H/H | B | D | A | D | A | A | B | D |
| | | | N/N | B | C | A | D | A | A | B | D |
| | | | L/L | A | B | A | C | A | A | B | B |

TABLE 7

List of properties of coating solutions

| Coating solution | Electrically conductive fine particles 1 | Parts added | Electrically conductive fine particles 2 | Parts added | Phenolic resin | Parts added | Quaternary phosphonium salt | Parts added | Electrically conductive spherical particles | Parts added |
|---|---|---|---|---|---|---|---|---|---|---|
| B1 | Carbon black | 12.5 | Graphitized particles A | 37.5 | P1 | 100 | 1 | 20 | 1 | 25 |
| B2 | ↑ | ↑ | ↑ | ↑ | ↑ | ↑ | 2 | ↑ | ↑ | ↑ |
| B3 | ↑ | ↑ | ↑ | ↑ | ↑ | ↑ | 4 | ↑ | ↑ | ↑ |
| B4 | ↑ | ↑ | ↑ | ↑ | ↑ | ↑ | Quaternary ammonium salt | ↑ | ↑ | ↑ |
| B5 | ↑ | ↑ | ↑ | ↑ | P4 | ↑ | 1 | ↑ | ↑ | ↑ |
| B6 | ↑ | ↑ | ↑ | ↑ | P1 | ↑ | Azo-type iron complex compound | ↑ | ↑ | ↑ |

TABLE 8

| Evaluation results of physical properties of coating solutions | | | | | | |
|---|---|---|---|---|---|---|
| | Coating solution | Viscosity (mPa · s) | Volume resistivity (Ω · cm) | Coating material particle size (μm) | 1 μm or less volume % | 10 μm or more volume % |
| Ex. 21 | B1 | 50 | 2.38 | 2.12 | 25.2 | 0.04 |
| | B1' | 55 | 2.66 | 2.19 | 24.7 | 0.06 |
| Ex. 22 | B2 | 48 | 2.22 | 2.25 | 24.8 | 0.04 |
| | B2' | 51 | 2.49 | 2.22 | 24.3 | 0.07 |
| Ex. 23 | B3 | 55 | 3.11 | 2.34 | 26.1 | 0.06 |
| | B3' | 63 | 3.52 | 2.42 | 23.9 | 0.12 |
| Com. Ex. 13 | B4 | 49 | 2.87 | 2.09 | 25.5 | 0.05 |
| | B4' | 150 | 4.89 | 4.95 | 10.2 | 16.2 |
| Com. Ex. 14 | B5 | 72 | 3.36 | 2.48 | 20.9 | 1.02 |
| | B5' | 29 | 7.12 | 3.51 | 18.6 | 1.55 |
| Com. Ex. 15 | B6 | 72 | 3.36 | 2.48 | 20.9 | 1.02 |
| | B6' | 29 | 7.12 | 3.51 | 18.6 | 1.55 |

TABLE 9

| Evaluation results | | | | | | | | | | | | | | |
|---|---|---|---|---|---|---|---|---|---|---|---|---|---|---|
| | | | | Continuously coated product evaluation | | | Image evaluation | | | | | | | |
| | | Developer | | | | | Image density | | Ghost | | Image unevenness | | Fogging | |
| | Coating solution | bearing member | Developer | Seediness defect | Image defect | Environment | Initial | After D.E.T. | Initial | After D.E.T. | Initial | After D.E.T. | Initial | After D.E.T. |
| Ex. 21 | B1' | S-19 | T-1 | A | A | H/H | A | A | B | A | A | A | B | A |
| | | | | | | N/N | A | A | A | A | A | A | A | A |
| | | | | | | L/L | A | A | A | A | A | A | A | A |
| Ex. 22 | B2' | S-20 | ↑ | A | A | H/H | A | A | B | A | A | A | B | A |
| | | | | | | N/N | A | A | B | A | A | A | A | A |
| | | | | | | L/L | A | A | B | A | A | A | A | A |
| Ex. 23 | B3' | S-21 | ↑ | B | B | H/H | A | B | C | B | A | A | A | A |
| | | | | | | N/N | A | C | B | B | A | B | A | B |
| | | | | | | L/L | A | C | B | B | A | C | A | C |
| Com. Ex. 13 | B4' | J-11 | ↑ | C | D | H/H | A | B | D | C | A | B | B | A |
| | | | | | | N/N | A | B | C | C | B | C | B | A |
| | | | | | | L/L | A | B | C | C | C | C | C | B |
| Com. Ex. 14 | B5' | J-12 | ↑ | B | B | H/H | A | A | D | D | B | A | B | A |
| | | | | | | N/N | A | B | C | B | C | B | C | A |
| | | | | | | L/L | A | D | B | B | D | B | C | B |
| Com. Ex. 15 | B6' | J-13 | ↑ | D | D | H/H | A | B | D | D | A | B | B | A |
| | | | | | | N/N | A | B | C | C | C | A | C | B |
| | | | | | | L/L | A | C | C | C | D | C | C | C |

As described above, according to the present invention, appropriate frictional charge can be imparted to a developer without excessively charging the developer even when many sheets are printed, and it is possible to suppress problems such as a decrease in density, sleeve ghosts and blotches even after making many prints. In addition, even when a coating material for forming an electrically conductive resin coating layer on the developer bearing member surface is stored for a long time, no change in viscosity and no pigment agglomeration occur, and thus, poor coating associated therewith during coating the developer bearing member can be inhibited from occurring, enabling a good electrically conductive resin coating layer to be formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-194737, filed Jul. 29, 2008, which is hereby incorporated by reference herein in its entirety.

What is claimed is:

1. A developer bearing member comprising a substrate and an electrically conductive resin coating layer formed on the surface thereof, wherein the electrically conductive resin coating layer is formed from a resin composition containing a phenolic resin having in its structure at least one selected from the group consisting of an —$NH_2$ group, an =NH group and an —NH— linkage, a quaternary phosphonium salt and electrically conductive fine particles;

the resin composition contains 1 part by mass or more and 60 parts by mass or less of the quaternary phosphonium salt with respect to 100 parts by mass of the phenolic resin; and the quaternary phosphonium salt is represented by the following Formula (1)

(1)

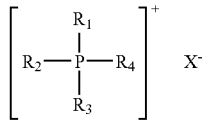

wherein $R_1$ to $R_3$ each independently represent an alkyl group having 1 to 4 carbon atoms that may have a substituent, a phenyl group that may have a substituent or a benzyl group that may have a substituent; $R_4$ represents an alkyl group having 1 to 16 carbon atoms that may have a substituent, an alkenyl group that may have a substituent, an alkynyl group that may have a substituent, a phenyl group that may have a substituent or a benzyl group that may have a substituent; and $X^-$ represents a halogen ion or $OH^-$.

2. The developer bearing member according to claim 1 wherein $R_1$ to $R_4$ and $X^-$ in the Formula (1) are defined as one of the following:

$R_1$ to $R_3$ each independently represent a phenyl group, $R_4$ is $(CH_2)_3CH_3$, and $X^-$ is $Br^-$;

$R_1$ to $R_3$ each independently represent a phenyl group, $R_4$ is $CH_2CH{=}CH_2$, and $X^-$ is $Br^-$;

$R_1$ to $R_3$ each independently represent a phenyl group, $R_4$ is $CH_2CH_3$, and $X^-$ is $I^-$;

$R_1$ to $R_3$ each independently represent a phenyl group, $R_4$ is $CH_2$-phenyl group, and $X^-$ is $Br^-$;

$R_1$ to $R_4$ each independently represent a phenyl group, and $X^-$ is $Br^-$;

$R_1$ to $R_3$ each independently represent a phenyl group, $R_4$ is $(CH_2)_3CH_3$, and $X^-$ is $I^-$;

$R_1$ to $R_4$ each independently represent a phenyl group, and $X^-$ is $I^-$;

$R_1$ to $R_3$ each independently represent a phenyl group, $R_4$ is $(CH_2)_3CH_3$, and $X^-$ is $Cl^-$;

$R_1$ to $R_4$ each independently represent $CH_2CH_3$, and $X^-$ is $OH^-$;

$R_1$ to $R_3$ each independently represent a phenyl group, $R_4$ is $CH_2CO(OCH_3)$, and $X^-$ is $Br^-$;

$R_1$ to $R_4$ each independently represent $CH_2CH_2CH_2CH_3$, and $X^-$ is $Br^-$; and $R_1$ to $R_3$ each independently represent $(CH_2)_3CH_3$, $R_4$ is $(CH_2)_{15}CH_3$, and $X^-$ is $Br^-$.

3. The developer bearing member according to claim 1 wherein the electrically conductive fine particles are electrically conductive carbon black, graphitized particles or a mixture thereof.

4. A development apparatus comprising a negatively chargeable developer, a development container for storing the negatively chargeable developer, a developer bearing member rotatively held to carry on its surface and convey the negatively chargeable developer fed from the development container and a developer layer thickness control member for controlling a thickness of a layer of the negatively chargeable developer formed on the developer bearing member, wherein the developer bearing member is a developer bearing member according to claim 1.

5. The development apparatus according to claim 4 wherein the negatively chargeable developer has an average circularity of 0.970 or more and a frictional charge quantity of the negatively chargeable developer due to friction with an iron powder carrier passing through a 100-mesh sieve and retained on a 200-mesh sieve is −80 mC/kg or more and −25 mC/kg or less.

6. The development apparatus according to claim 4, wherein the negatively chargeable developer comprises a binding resin, an iron oxide and toner particles comprising a sulfur-containing resin, and the sulfur-containing resin has a constituent unit derived from sulfonic acid group-containing (meth)acrylamide.

7. A development method comprising using a development apparatus according to claim 4 to convey a developer to a development region opposite to an electrostatic latent image bearing member and to allow the conveyed developer to develop an electrostatic latent image carried on the electrostatic latent image bearing member for visualization.

* * * * *